US006090762A

United States Patent [19]

Clapperton et al.

[11] Patent Number: 6,090,762

[45] Date of Patent: Jul. 18, 2000

[54] AQUEOUS BASED SURFACTANT COMPOSITIONS

[75] Inventors: Richard Malcolm Clapperton, Stourbridge; John Reginald Goulding, Nr. Driffield; Boyd William Grover, Bromsgrove; Ian Foster Guthrie, Cleator Moor; William Paul Haslop, Cumbria; Edward Tunstall Messenger, Workington; Jill Elizabeth Newton, Nr. Stourbridge; Stewart Alexander Warburton, Whitehaven, all of United Kingdom

[73] Assignee: Albright & Wilson UK Limited, West Midlands, United Kingdom

[21] Appl. No.: 09/038,270

[22] Filed: Mar. 10, 1998

Related U.S. Application Data

[62] Division of application No. 08/684,269, Jul. 17, 1996, which is a continuation of application No. 08/538,188, Aug. 23, 1995, abandoned, which is a continuation of application No. 08/239,285, May 6, 1994, abandoned.

[30] Foreign Application Priority Data

| | | | |
|---|---|---|---|
| May 7, 1993 | [GB] | United Kingdom | 9309475 |
| Jun. 14, 1993 | [GB] | United Kingdom | 9312195 |
| Oct. 13, 1993 | [GB] | United Kingdom | 9321142 |
| Apr. 5, 1994 | [GB] | United Kingdom | 9406678 |

[51] Int. Cl.[7] ..... C11D 3/37; C11D 3/34

[52] U.S. Cl. ..... 510/108; 510/119; 510/159; 510/337; 510/405; 510/418; 510/475; 510/476; 510/492

[58] Field of Search ..... 510/405, 418, 510/119, 159, 475, 476, 492, 337, 108

[56] References Cited

U.S. PATENT DOCUMENTS

| | | |
|---|---|---|
| 3,077,469 | 2/1963 | Aszalos . |
| 3,498,943 | 3/1970 | Dannals . |
| 3,668,230 | 6/1972 | Dannals . |
| 3,772,382 | 11/1973 | Dannals . |
| 3,776,874 | 12/1973 | Dannals . |
| 3,839,405 | 10/1974 | Dannals . |
| 3,922,230 | 11/1975 | Lamberti et al. . |
| 4,095,035 | 6/1978 | Lamberti et al. . |
| 4,132,735 | 1/1979 | Lamberti et al. . |
| 4,460,480 | 7/1984 | Kleiner et al. . |
| 4,488,981 | 12/1984 | Urfer et al. . |
| 4,515,704 | 5/1985 | Akred et al. . |
| 4,618,446 | 10/1986 | Haslop et al. . |
| 4,659,497 | 4/1987 | Akred et al. . |
| 4,675,127 | 6/1987 | Kickle et al. . |
| 4,793,943 | 12/1988 | Haslop et al. . |
| 4,871,467 | 10/1989 | Akred et al. . |
| 5,008,032 | 4/1991 | Diessel et al. . |
| 5,071,586 | 12/1991 | Kaiserman et al. . |
| 5,073,285 | 12/1991 | Libertati et al. . |
| 5,077,329 | 12/1991 | Pastor et al. . |
| 5,147,576 | 9/1992 | Montague et al. . |
| 5,198,353 | 3/1993 | Hawkins et al. . |
| 5,269,960 | 12/1993 | Gray et al. . |
| 5,429,754 | 7/1995 | Lin et al. . |
| 5,489,397 | 2/1996 | Bainbridge . |
| 5,494,602 | 2/1996 | Thomaides et al. . |
| 5,597,508 | 1/1997 | Schepers et al. . |
| 5,602,092 | 2/1997 | Repinec, Jr. et al. . |

FOREIGN PATENT DOCUMENTS

| | | |
|---|---|---|
| 65406/90 | 5/1991 | Australia . |
| 68733/91 | 5/1991 | Australia . |
| 66078/90 | 6/1991 | Australia . |
| 66492/90 | 7/1991 | Australia . |
| 0 097 063 | 12/1983 | European Pat. Off. . |
| 0 136 844 | 4/1985 | European Pat. Off. . |
| 0 346 834 | 12/1989 | European Pat. Off. . |
| 0 415 698 | 3/1991 | European Pat. Off. . |
| 0 419 264 | 3/1991 | European Pat. Off. . |
| 0 430 602 A1 | 6/1991 | European Pat. Off. . |
| 0 452 106 A2 | 10/1991 | European Pat. Off. . |
| 0 498 231 | 8/1992 | European Pat. Off. . |
| 0 530 708 A2 | 10/1993 | European Pat. Off. . |
| 2 669 331 | 5/1992 | France . |
| 62-277498 | 12/1987 | Japan . |
| 1 310 730 | 12/1989 | Japan . |
| 1-310730 | 12/1989 | Japan . |
| 1068554 | 5/1967 | United Kingdom . |
| 1 506 427 | 4/1978 | United Kingdom . |
| 2 237 813 | 5/1991 | United Kingdom . |
| WO 91/00331 | 1/1991 | WIPO . |
| 9 105 845 | 5/1991 | WIPO . |
| WO 91/08280 | 6/1991 | WIPO . |
| WO 91/12307 | 8/1991 | WIPO . |
| WO 94/03575 | 2/1994 | WIPO . |

*Primary Examiner*—Lorna M. Douyon
*Attorney, Agent, or Firm*—Frishauf, Holtz, Goodman, Langer & Chick, P.C.

[57] ABSTRACT

The use of a stabiliser comprising a hydrophilic polymeric chain of more than four hydrophilic monomer groups and/or having a mass greater than 300 amu, linked at one end to a hydrocarbon-soluble hydrophobic group to reduce or prevent the flocculation of systems comprising a flocculable surfactant and a liquid medium which is capable of flocculating the surfactant and in which the stabiliser is capable of existing as a micellar solution at a concentration of at least 1% by weight.

1 Claim, No Drawings

AQUEOUS BASED SURFACTANT COMPOSITIONS

This is a division of application Ser. No. 08/684,269 filed Jul. 17, 1996, which is a continuation application of Ser. No. 08/538,188, filed Aug. 23, 1995, abandoned, which is a continuation application of Ser. No. 08/239,285 filed May 6, 1994, abandoned.

INTRODUCTION

The present invention relates to concentrated aqueous based surfactant compositions containing high levels of surfactant and/or electrolyte which would normally provide either a product with an undesirably high viscosity, or one which separates into two or more phases on standing, or exhibits signs of excessive flocculation of the surfactant.

Liquid laundry detergents have a number of advantages compared with powders which have led to their taking a substantial proportion of the total laundry detergent market. The need to suspend sparingly soluble builders such as sodium tripolyphosphate, or insoluble builders such as zeolite in the pourable aqueous surfactant medium led to the development of structured surfactants. These are pseudoplastic compositions in which the structurant is a surfactant or a surfactant/water lyotropic mesophase.

The introduction of compact powders containing higher concentrations of active ingredient than the traditional powders has challenged the trend towards liquids. There is a market requirement for more concentrated liquids to meet this challenge, and in particular concentrated aqueous surfactant compositions containing dissolved or suspended builder salts. The addition of high levels of surfactant and/or dissolved electrolyte can promote flocculation of the structured surfactant resulting in high viscosities and/or instability.

The problem of suspending water-insoluble or sparingly soluble pesticides in a fluid medium has called for new approaches to avoid the use of environmentally unacceptable solvents. Structured surfactant systems represent one such approach. Flocculation of the systems, together with crystal growth of the suspended solids has, however, been a serious limitation on the development of suitable products.

Dyes and pigments, which are water-insoluble or sparingly soluble also need to be suspended in pourable liquid concentrates to avoid handling fine powders when preparing dyebaths, or to provide printing inks.

Attempts to suspend dyes and pigments in structured surfactants have been hindered by the tendency of the surfactant structure to flocculate or break down in the presence of the polyelectrolytes which are commonly added to pigments prior to milling, and which act as milling aids.

Cosmetic, toiletry and pharmaceutical formulations also frequently require the preparation of stable suspensions of dispersed solids or liquids in a pourable aqueous medium which may require to be highly concentrated with respect to electrolyte, surfactant or both, or to incorporate polyelectrolyte.

Oilfield drilling muds are used to lubricate drill bits and to transport rock cuttings from the bit to the surface. Structured surfactants have been found to provide the required rheology and solid suspending power. Such muds require to be able to tolerate very high electrolyte concentrations, e.g. when the borehole penetrates a salt dome. They usually contain weighting agents such as barite, calcite or haematite to facilitate penetration to great depths.

However in the final stages of drilling these are often replaced by completion fluids which contain soluble weighting agents such as calcium chloride or bromide. These dissolved alkaline earth metal electrolytes are highly flocculating toward most surfactant structures.

The ability to concentrate liquid detergent or other surfactant systems was once limited by the tendency of most surfactants to form viscous mesophases at concentrations above 30% by weight, based on the weight of water and surfactant. Mesophases, or liquid crystal phases, are phases which exhibit a degree of order less than that of a solid but greater than that of a classical liquid, e.g. order in one or two, but not all three dimensions.

Up to about 30% many surfactants form micellar solutions ($L_1$-phase) in which the surfactant is dispersed in water as micelles, which are aggregates of surfactant molecules, too small to be visible through the optical microscope.

Micellar solutions look and behave for most purposes like true solutions. At about 30% many detergent surfactants form an M-Phase, which is a liquid crystal with a hexagonal symmetry and is normally an immobile, wax-like material. Such products are not pourable and obviously cannot be used as liquid detergents. At higher concentrations, e.g. above about 50% by weight, usually over some concentration range lying above 60% and below 80% a more mobile phase, the G-phase, is formed.

G-phases are non-Newtonian (shear thinning) normally pourable phases, but typically have a viscosity, flow characteristic and cloudy, opalescent appearance, which render them unattractive to consumers and unsuitable for use directly as, e.g., laundry detergents. Early attempts to suspend solids in typical G-phases were unsuccessful, giving rise to products which were not pourable. However thin mobile G-phases, having a relatively wide d-spacing have been reported, which are capable of suspending solids to form pourable suspensions.

At still higher concentrations e.g. above about 70 or 80% most surfactants form a hydrated solid. Some, especially non-ionic surfactants, form a liquid phase containing dispersed micelle size droplets of water ($L_2$-phase). $L_2$ phases have been found unsuitable for use as liquid detergents because they do not disperse readily in water, but tend to form gels. They cannot suspend solids. Other phases which may be observed include the viscous isotropic (V) phase which is immobile and has a vitreous appearance.

The different phases can be recognised by a combination of appearance, rheology, textures under the polarising microscope, electron microscopy and X-ray diffraction or neutron scattering.

Definitions

The following terms may require explanation or definition in relation to the different phases discussed in this specification: "Optically isotropic" surfactant phases do not normally tend to rotate the plane of polarisation of plane polarised light. If a drop of sample is placed between two sheets of optically plane polarising material whose planes of polarisation are at right angles, and light is shone on one sheet, optically isotropic surfactant samples do not appear substantially brighter than their surroundings when viewed through the other sheet. Optically anisotropic materials appear substantially brighter. Optically anisotropic mesophases typically show characteristic textures when viewed through a microscope between crossed polarisers, whereas optically isotropic phases usually show a dark, essentially featureless continuum.

"Newtonian liquids" have a viscosity which remains constant at different shear rates, for the purpose of this specification, liquids are considered Newtonian if the viscosity does not vary substantially at shear rates up to 1000 $sec^{-1}$.

$L_1$ phases are mobile, optically isotropic, and typically Newtonian liquids which show no texture under the polarising microscope. Electron microscopy is capable of resolving the texture of such phases only at very high magnifications, and X-ray or neutron scattering normally gives only a single broad peak typical of a liquid structure, at very small angles. The viscosity of an $L_1$-phase is usually low, but may rise significantly as the concentration approaches the upper phase boundary.

$L_1$ phases are single, thermodynamically stable phases and may be regarded as aqueous solutions in which the solute molecules are aggregated into spherical, rod shaped or disc shaped micelles, which usually have a diameter of about 4 to 10 nanometers.

"Lamellar" phases are phases which comprise a plurality of bilayers of surfactant arranged in parallel and separated by liquid medium. They include both solid phases and the typical form of the liquid crystal G-phase. G-phases are typically pourable, non-Newtonian, anisotropic products. They are typically viscous looking, opalescent materials with a characteristic "smeary" appearance on flowing. They form characteristic textures under the polarising microscope and freeze fractured samples have a lamellar appearance under the electron microscope. X-ray diffraction or neutron scattering similarly reveal a lamellar structure with a principal peak typically between 4 and 10 nm, usually 5 to 6 nm. Higher order peaks, when present occur at double or higher integral multiples of the Q value of the principal peak. Q is the momentum transfer vector and is related, in the case of lamellar phases, to the repeat spacing d by the equation, $$Q = \frac{2n\pi}{d}$$

where n is the order of the peak.

G-phases, however, can exist in several different forms, including domains of parallel sheets which constitute the bulk of the typical G-phases described above and spherulites formed from a number of concentric spheroidal shells, each of which is a bilayer of surfactant. In this specification the term "lamellar" will be reserved for compositions which are at least partly of the former type. Opaque compositions at least predominantly of the latter type in which the continuous phase is a substantially isotropic solution containing dispersed spherulites are referred to herein as "spherulitic". The spherulites are typically between 0.1 and 50 microns in diameter and so differ fundamentally from micelles. Unlike micellar solutions, spherulitic compositions are essentially heterogeneous systems comprising at least two phases. They are anisotropic and non-Newtonian. When close packed and stable, spherulites have good solid suspending properties. Compositions in which the continuous phase comprises non-spherulitic bilayers usually contain some spherulites but are typically translucent in the absence of a dispersed solid or other phase, and are referred to herein as "G-phase compositions". G-phases are sometimes referred to in the literature as $L_\alpha$ phases.

M-phases are typically immobile, anisotropic products resembling waxes. They give characteristic textures under the polarising microscope, and hexagonal diffraction pattern by X-ray or neutron diffraction which comprises a major peak, usually at values corresponding to a repeat spacing between 4 and 10 nm, and sometimes higher order peaks, the first at a Q value which is $3^{0.5}$ times the Q value of the principal peak and the next double the Q value of the principal peak. M-phases are sometimes referred to in the literature as H-phases.

$L_2$ phases are the inverse of the $L_1$ phase, comprising micellar solutions of water in a continuous liquid surfactant medium. Like $L_1$ phases, they are isotropic and Newtonian.

The viscous isotropic or "VI" phases are typically immobile, non-Newtonian, optically isotropic and are typically transparent, at least when pure. VI phases have a cubic symmetrical diffraction pattern, under X-ray diffraction or neutron scattering with a principal peak and higher order peaks at $2^{0.5}$ and $3^{0.5}$ times the Q-value of the principal peak.

One such cubic liquid crystalline phase has been reported immediately following the micellar phase at ambient temperature as the concentration of surfactant is increased. It has been proposed that such a VI phase, sometimes referred to as the $I_1$ phase, may arise from the packing of micelles (probably spherical) in a cubic lattice. At ambient temperature a further increase in surfactant concentration usually results in hexagonal phase ($M_1$), which may be followed by a lamellar phase (G). $I_1$ phases, when they occur, are usually only observed over a narrow range of concentrations, typically just above those at which the $L_1$-phase is formed. The location of such VI phases in a phase diagram suggests that the phase is built up of small closed surfactant aggregates in a water continuum.

An inverse form of the $I_1$ phase (the $I_2$ phase) has also been reported possibly between the inverse hexagonal ($M_2$) and $L_2$ phases. It consists of a surfactant continuum containing a cubic array of water micelles. An alternative form of the VI phase called the $V_1$ phase has been observed at concentrations between the M and G phases and may comprise a bicontinuous system. This may exhibit an even higher viscosity than the $I_1$. An inverse phase, the $V_2$ phase, between the G and $M_2$ phases has also been postulated.

Several other mesophases have been observed or proposed, including nematic phases which contain thread-like structures.

The term "structured surfactant" is used herein to refer to pourable, fluid, non-Newtonian compositions which have the capacity physically to suspend solid particles by virtue of the presence of a surfactant mesophase or solid phase, which may be interspersed with a solvent phase. The latter is commonly an aqueous electrolyte phase. The surfactant phase is usually present as packed spherulites dispersed in the aqueous phase. Alternatively a thin mobile lamellar phase or a bicontinuous reticular interspersion of aqueous and lamellar phases may be present. Hexagonal phases are usually insufficiently mobile to form the basis of a structured surfactant, but may, exceptionally be present. Cubic phases have not been observed to be sufficiently mobile. $L_1$ or $L_2$ phases are not, in themselves structured and lack suspending properties but may be present e.g. as the continuous liquid phase, in which a lamellar or spherulitic phase is dispersed, or as a dispersed phase, e.g. dispersed in a continuous lamellar or isotropic phase.

Structured surfactants differ from microemulsions which are thermodynamically stable systems. A microemulsion is essentially a micellar solution ($L_1$ phase) in which a hydrophobic material is encapsulated in the micelles.

Structured surfactants also differ from colloidal systems which are kinetically stable. In colloidal systems the particles of dispersed phase are small enough (e.g. less than 1 micron) to be affected by Brownian motion. The dispersion is thus maintained by the constant agitation of the internal phase. In contrast structured surfactants appear to be mechanically stable, the particles being immobilised within the surfactant structure. While the system is at rest, no movement of the suspended particles can be detected, but the shear stresses associated with pouring are sufficient to break the structure and render the product mobile.

Except when stated to the contrary references herein to Viscosity are to the viscosity measured an a Brookfield Viscometer, spindle 4, at 100 rpm and 20° C. This corresponds to a shear rate of approximately 21 $sec^{-1}$. It is an indication of the pourability of non-Newtonian liquids.

Technical Problem

It is often desired to disperse solids or liquids in an aqueous medium in excess of their solubilities therein. Such dispersions should ideally be pourable and remain evenly dispersed after prolonged standing.

Structured surfactants have been found to offer a number of advantages as suspending media over more conventional methods of dispersion such as colloids, microemulsions or the use of viscosifiers, or mineral structurants.

Examples of systems to which structured surfactants have been applied include laundry detergents containing solid builders, hard surface cleaners containing abrasive particles, toiletries, dye and pigment suspensions, pesticide suspensions, drilling muds and lubricants.

Aqueous structured surfactant compositions such as liquid laundry detergents, toiletries and suspending media for pesticides, dyes and other solids are often required to contain high levels of surfactant and/or electrolyte.

The surfactant is usually present as spherulites. The spherulites have a marked tendency to flocculate, especially at high electrolyte concentration. This tendency can cause instability and/or excessively high viscosity.

Similar effects have been observed with other structured surfactant systems. The object of the invention is to reduce the flocculation and/or viscosity, and/or increase the stability of such viscous, flocculated and/or unstable structured surfactants.

A particular type of surfactant which often gives rise to problems of instability or flocculation is the group comprising fabric conditioners. These typically have two $C_{15}$ to $_{25}$ alkyl or alkenyl groups (usually tallow groups) and are ordinarily cationic or amphoteric.

A particular problem is to obtain high levels of builder in a composition containing an effective surfactant combination for washing synthetic fabrics. High levels of solid builder such as sodium tripolyphosphate or zeolite have been found to lead to unacceptably high viscosity.

Problems of surfactant stability or flocculation are not always confined to compositions containing excessive levels of electrolyte. They also arise when attempts are made to include soluble polymers in structured surfactant systems. Such polymers may be desired for example as soil suspending agents, milling aids, film forming agents in paints or enamels or to prevent crystal growth in pesticide suspensions.

A further problem with zeolite built detergents is that they tend to be less effective in terms of soil removal than polyphosphate built detergents. It has been noted in EP-A-0 419 264 that the effectiveness of zeolites as builders can be greatly enhanced by the presence as a co-builder of certain aminophosphinates which are usually obtained in an oligomeric form. Unfortunately it has not been found possible to incorporate significant amounts of aminophosphinates in zeolite built liquid detergents without causing phase separation.

PRIOR ART

Structured surfactants in detergents have been described in a very large number of publications, including GB 2 123 846, GB 2 153 380, EP-A-0452 106 and EP-A-0530 708.

The following specifications also refer to structured detergents:

| | | |
|---|---|---|
| AU 482374 | GB 855679 | U.S. Pat. No. 2,920,045 |
| AU 507431 | GB 855893 | U.S. Pat. No. 3,039,971 |
| AU 522983 | GB 882569 | U.S. Pat. No. 3,075,922 |
| AU 537506 | GB 943217 | U.S. Pat. No. 3,232,878 |
| AU 542079 | GB 955082 | U.S. Pat. No. 3,235,505 |
| AU 547579 | GB 1262280 | U.S. Pat. No. 3,281,367 |
| AU 548438 | GB 1405165 | U.S. Pat. No. 3,328,309 |
| AU 550003 | GB 1427011 | U.S. Pat. No. 3,346,503 |
| AU 555411 | GB 1468181 | U.S. Pat. No. 3,346,504 |
| | GB 1506427 | U.S. Pat. No. 3,351,557 |
| CA 917031 | GB 1577120 | U.S. Pat. No. 3,509,059 |
| | GB 1589971 | U.S. Pat. No. 3,374,922 |
| CS 216492 | GB 2600981 | U.S. Pat. No. 3,629,125 |
| | GB 2028365 | U.S. Pat. No. 3,638,288 |
| DE A1567656 | GB 2031455 | U.S. Pat. No. 3,813,349 |
| | GB 2054634 | U.S. Pat. No. 3,956,158 |
| DE 2447945 | GB 2079305 | U.S. Pat. No. 4,019,720 |
| | | U.S. Pat. No. 4,057,506 |
| EP 0028038 | JP-A-52-146407 | U.S. Pat. No. 4,107,067 |
| EP 0038101 | JP-A-56-86999 | U.S. Pat. No. 4,169,817 |
| EP 0059280 | | U.S. Pat. No. 4,265,777 |
| EP 0079646 | SU 498331 | U.S. Pat. No. 4,279,786 |
| EP 0084154 | SU 922066 | U.S. Pat. No. 4,299,740 |
| EP 0103926 | SU 929545 | U.S. Pat. No. 4,302,347 |
| FR 2283951 | | |

although in most instances the structures which would have been present in the formulations as described were insufficiently stable to maintain solids in suspension.

Structured surfactants in pesticide formulations were described in EP-A-0 388 239.

Structured surfactants in drilling muds and other functional fluids were described in EP-A-0 430 602.

Structured surfactants in dye and pigment suspensions were described in EP-A-0 472 089.

EP-0 301 883, describes the use of certain polymers as viscosity reduction agents in liquid detergents. The polymers described in the above publication are not however particularly effective. As a result, a number of patents have been published relating to more specialised polymers intended to provide greater viscosity reductions (see for example EP-A-0 346 993, EP-A-0 346 994, EP-A-0 346 995, EP-A-0 415 698, EP-A-0 458 599, GB 2 237 813, WO 91/05844, WO 91/05845, WO 91/06622, WO 91/06623, WO 91/08280, WO 91/08281, WO 91/09102, WO 91/09107, WO91/09108, WO 91/09109 and WO 91/09932). Certain of these polymers are said to be deflocculants and others to cause osmotic shrinkage of the spherulites. These polymers are relatively expensive products, which make relatively little contribution to the washing effectiveness of the formulation. They typically have a comb like architecture with a hydrophilic polymer backbone carrying a plurality of hydrophobic side chains, or vice versa.

THE INVENTION

We have now discovered that certain surfactants which form micelles and which are soluble in the aqueous electrolyte phase of the structured surfactant to the extent of at least 1% by weight, are highly effective at deflocculating flocculated spherulitic or other surfactant systems, lowering the viscosity of excessively viscous systems and/or stabilising unstable structured surfactant formulations. Moreover they contribute to the surfactancy and sometimes also to the building effect of the formulation.

The stabilisers and/or deflocculants for use according to the invention are surfactants having a $C_{5-25}$ hydrophobic group such as an alkyl alkenyl or alkylphenyl group, especially a $C_{6-20}$ alkyl, alkenyl or alkylphenyl group, and a hydrophilic group which is typically a polymer of a hydrophilic monomer or, especially, of a monomer with hydrophilic functional substituents or a chain onto which hydrophilic substituents have been introduced and which is linked at one end to said hydrophobic group. Said hydrophilic group preferably has a mean mass greater than 300 amu more usually greater than 500, preferably greater than 900, and especially greater than 1,000 amu. The hydrophilic group is usually a polymer containing more than 4 e.g. from about six to eighty monomer units, depending on the size of the monomer and the repeat spacing of the surfactant structure. Compounds which form micelles in the aqueous phase of the system to be deflocculated, which have a hydrophobic group of at least five carbon atoms linked at one point to one end of at least one hydrophilic group having a mass of at least 300 amu and/or comprising more than four hydrophilic monomer units and which are compatible with the surfactant to be deflocculated, are referred to herein as "said stabilisers". The choice of surfactants to act as said stabilisers depends upon the nature and concentration of the electrolyte phase and of the surfactant which it is desired to deflocculate.

The stabiliser must be compatible with the surfactant phase to be deflocculated. Thus anionic stabilisers should not be used in conjunction with cationic surfactants, and vice versa. Structured surfactants are usually anionic and/or nonionic with amphoteric sometimes included, usually as a minor ingredient. For such systems anionic or nonionic stabilisers are preferred. For cationic structured systems cationic or non-ionic stabilisers are preferred.

The following discussion is based on the assumption that the surfactant is primarily Anionic and/or nonionic unless stated to the contrary.

A common type of electrolyte especially in laundry detergents is the multivalent anionic type such as sodium and or potassium tripolyphosphate or potassium or sodium citrate, which on account of its solubility and building capacity, is often used where high electrolyte concentrations are required.

In solutions containing high concentrations (e.g. more than 16% wt/wt) of sodium citrate, or other multivalent anionic electrolyte solution a preferred example of said stabilisers is an alkanol or alkyl thiol terminated polyelectrolyte such as a polyacrylate, polymethacrylate or polycrotonate.

Water-soluble polyacrylates with in alkanol or mercaptan chain terminator are known for use in the coating, adhesive paper and non-woven textile industries (eg. JP 04081405, JP 01038405 and JP 62085089) and for use in manufacture of latices (eg. JP 62280203 and DE 15957384). Calcium salts of 15 similar polymers are also described in JP 013107301 for use as dispersants for carbon black or iron oxide in water.

We have discovered that a polycarboxylate or other polyelectrolyte having more than 4 hydrophilic monomer units whose chains are capped e.g. with a $C_{6-25}$ aliphatic alcohol, thiol or amine or with a $C_{6-25}$ aliphatic carboxylate, phosphate, phosphonate, phosphinate or phosphite ester group (hereinafter referred to as "said polyelectrolyte stabiliser") is more effective than the polymers previously proposed for deflocculating, reducing the viscosity of, or stabilising liquid detergents which contain electrolytes with multivalent anions. Said polyelectrolyte stabilisers also enhance the performance of the liquid detergent.

Another type of polyelectrolyte of use as said stabiliser in electrolytes with multivalent anions is an alkyl ether polycarboxylate product formed by the addition of unsaturated carboxylic acids such as itaconic, maleic or fumaric acid or their salts to a compound having a $C_{8-25}$ alkyl group and a polyoxyethylene chain, such as a polyethoxylated alcohol, e.g. using a free radical initiator. The product typically may have one or preferably more ethoxy groups and on or preferably more 1,2-dicarboxy ethyl groups.

Such alkylether polycarboxylates are described for instance in EP 0129328, and in copending British Patent application No. 93 14277.6.

Another example of said stabilisers is an alkyl capped polysulphomaleate.

Another example of said stabilisers which is effective in a multivalent anionic electrolyte is an alkyl polyglycoside having a relatively high degree of polymerisation. We have discovered that alkyl polyglycosides are also extremely effective at providing reduced viscosity and improved stability of concentrated, aqueous structured surfactant systems, together with enhanced performance.

Another example of said stabilisers which is useful in multivalent anionic electrolyte is a glycolipid or sugar ester. Monosaccharide esters are not effective, and disaccharide ester such as sucrose and maltose esters are of very limited use, but higher oligosaccharlde esters such as maltopentaose palmitate provide an effect. Esters with more than 4 glycoside groups are preferred. The effect of glycolipids on aggregated liposomes was noted in J. Collold and Interface Sci. Vol 152 NO. 2 September 1992.

We have discovered that alkyl ethoxylates are generally not sufficiently soluble in high concentrations of the multivalent anionic type of electrolyte to function as said stabiliser in such systems. For example a $C_{12}$ to $_{14}$ fifty mole ethoxylate was found to form micelles in 15% wt/wt aqueous sodium citrate but not in 20%. The stabilising activity of the ethoxylate reflected this difference in solubility.

A second type of electrolyte is the multivalent cation type such as calcium chloride which is required, for example, as a soluble weighting agent in drilling muds. Polycarboxylates are generally insufficiently soluble to function as said stabiliser in the presence of high concentrations of multivalent cation. Polysulphonates such as alkyl poly vinyl sulphonates or alkyl poly (2- acrylamido-2-methyl propane sulphonates) are preferred, and alkyl polyethoxylates e.g. containing more than 6, e.g. more than 20 ethylene oxy units are also effective.

A third type of electrolyte comprises monovalent cations and anions, e.g. potassium chloride at high concentration. Polyelectrolytes are less soluble in such systems, but higher polyethoxylates such as alkyl 7 to 80 mole polyethoxylates function well as said stabiliser.

A further example of an electrolyte which can cause serious problems of flocculation even in relatively low concentrations is a conventional polyelectrolyte such as a naphthalene sulphonate formaldehyde copolymer, carboxymethyl cellulose or an uncapped polyacrylate or polymaleate. Such (typically) non-micelle-forming polymers are often required in structured surfactant systems. For example pigment suspensions require milling to a very fine particle size, and polyelectrolytes are frequently added in small amounts as milling aids, resulting in serious problems of flocculation of the structured surfactant.

We have discovered that alcohol thoxylates are usually highly effective in deflocculating such systems, and also systems in which the instability or high viscosity are due to the presence of other types of soluble polymer.

We have further discovered that, in the presence of said stabiliser, relatively high levels of aminophosphinates can be introduced into liquid detergent compositions without giving rise to any significant instability.

We have further discovered that when deflocculants such as said stabilisers are progressively added to unstable or viscous formulations the viscosity is initially reduced until a stable fluid product is obtained. If more deflocculant is added the viscosity then rises to a maximum before falling again, with further additions leading to a translucent highly mobile G-phase composition, with good suspending properties. Further additions may provide a clear $L_1$ phase, apparently unstructured. This product is of potential value as a clear detergent or shampoo for applications where solid suspending properties are not required.

We have found that high levels of builder and highly effective washing performance for synthetic fabrics can be achieved by incorporating relatively high levels of non-ionic surfactant together with a water soluble builder such as potassium pyrophosphate, or potassium tripolyphosphate, especially in conjunction with suspended builder such as sodium tripolyphosphate.

In such systems, which require high concentrations of electrolyte and high proportions of nonionic surfactant, especially non-ionic surfactant of the polyethoxylate type, we have discovered that a novel type of heterogeneous structured surfactant system is formed which is normally very viscous. The novel system comprises an isotropic phase which we believe is a surfactant rich phase such as an $L_2$ phase, dispersed in a continuous phase which may be or may comprise an isotropic phase which we believe is an $L_1$ phase, or in certain cases, an anistropic phase such as a lamellar phase. Alternatively in certain instances the dispersed phase may comprise an $L_1$ phase in a continuous lamellar phase. In addition we do not rule out the formation of dispersions of an $L_1$ in an $L_2$ phase.

We have discovered that such novel structured surfactant systems may be stabilised by said stabilisers to form useful solid suspending systems.

STATEMENT OF INVENTION

According to one embodiment, the present invention provides the use of a stabiliser comprising a hydrocarbon-soluble hydrophobic group, linked at one end to one end of at least one hydrophilic group which is a polymeric chain of more than four hydrophilic monomer groups and/or which has a mass greater than 300 amu, to reduce or prevent the flocculation of systems comprising a flocculable surfactant compatible with said stabiliser and a liquid medium which is capable of flocculating said surfactant and in which said stabiliser is capable of existing as a micellar solution.

According to a second embodiment our invention provides the use of a compound which forms micelles in aqueous solutions of 18% by weight potassium citrate and which comprises a $C_6$ to $_{25}$ aliphatic or alkaryl hydrophobic group, one end of which is linked to one end of at least one hydrophilic group having a mass greater than 300 amu and/or comprising more than four hydrophilic monomer units to lower the viscosity of viscous structured surfactant systems and/or to convert unstable surfactant systems into stable structured or micellar surfactant systems, where said systems contain at least 10% by weight, based on the total weight of the system of a dissolved surfactant-desolubilising electrolyte having a multivalent anion.

Our invention provides as a third embodiment the use of a $C_{5-25}$ alkyl alkenyl or alkaryl ether polycarboxylate, a $C_5$ to $_{25}$ alkyl, alkenyl or alkaryl polyglycoside or of said polyelectrolyte stabiliser as hereinbefore defined to stabilise, or to reduce the viscosity of, an aqueous anionic, nonionic and/or amphoteric surfactant-containing composition comprising a dissolved electrolyte having a multivalent anion.

According to a fourth embodiment the invention provides an aqueous surfactant composition comprising: at least one surfactant which is capable of forming a flocculated system alone and/or in the presence of a flocculant; an aqueous continuous phase containing sufficient flocculent, where required, to form with said surfactant-a flocculated system; and a stabiliser which is a compound capable of forming micelles in said aqueous phase said stabiliser having a hydrophobic group with at least five carbon atoms linked at one end to one end of at least one hydrophilic group with a mass greater than 300 amu and/or comprising at least five hydrophilic monomer units, and being present in an amount sufficient to inhibit the flocculation of the system.

According to a fifth embodiment the invention provides an aqueous structured surfactant composition comprising essentially: water; at least one structure-forming surfactant; a proportion of a dissolved surfactant-flocculating agent, based on the weight of water, sufficient to form with said structure-forming surfactant and water a (i) flocculated, (ii) unstable and/or (iii) viscous structured surfactant composition; and at least one stabiliser which is a micelle-forming compound which comprises a $C_5$ to $_{20}$ alkyl group linked to one end of a hydrophilic group, said hydrophilic group having a mass greater than 300 amu and/or comprising a polymer with more than four hydrophilic monomomer units, such that said stabiliser is capable for forming micelles in an aqueous solution containing said electrolyte in said proportion, said stabiliser being present in an amount sufficient to provide (i) a less flocculated, (ii) a more stable and/or (iii) a less viscous structured surfactant composition, respectively.

According to a sixth embodiment our invention provides an aqueous structured surfactant composition comprising: water; at least one structure-forming surfactant; a proportion of dissolved, surfactant-desolubilising electrolyte, based on the weight of said composition, sufficient to form with said water and surfactant a (i) flocculated, (ii) unstable and/or (iii) viscous structured surfactant composition; and a stabiliser comprising a micelle forming compound which comprises a $C_5$ to $_{25}$ alkyl, alkenyl or alkaryl group linked at one end to one end of at least one hydrophilic group, said hydrophilic group having a mass greater than 300 amu and/or comprising a polymer of at least four hydrophilic monomer units such that said stabiliser is capable of forming micelles in an aqueous solution containing said electrolyte in said proportion, said stabiliser being present in an amount sufficient to provide (i) a less flocculated, (ii) a more stable and/or (iii) a less viscous structured surfactant composition, respectively.

According to a seventh embodiment, our invention provides an aqueous-based, spherulitic composition comprising at least 10% by weight based on the weight of the composition of surfactant and at least 10% by weight based on the weight of said composition of dissolved electrolyte, adapted to form in the absence of said stabiliser, either (i) a composition which separates on standing into two or more portions, or (ii) a stable composition having a viscosity as herein defined greater than 0.8 Pa s, and sufficient of said stabiliser to (i) reduce or prevent said separation and/or (ii) lower said viscosity, respectively.

According to a eighth embodiment our invention provides a stable, pourable, spherulitic structured surfactant composition comprising: water; sufficient surfactant to form a structure in the presence of electrolyte; at least 10% by weight of a dissolved, surfactant-desolubilising salt having a multivalent anion, the concentration of said salt in said water being sufficient to form, with said water and said surfactant (i) an unstable, and/or (ii) a flocculated, spherulitic structured surfactant composition; and a stabiliser having a $C_{5-20}$ alkyl group linked at one end to one end of at least one hydrophilic group having a mass greater than 300 amu and a plurality of hydroxyl, carboxylato, sulphonate, phosphonate, sulphate or phosphate groups such that the stabiliser is soluble in an aqueous solution of said salt at said concentration, said stabiliser being present in an amount sufficient to provide (i) a more stable, and/or (ii) a less viscous spherulitic composition respectively.

According to a ninth embodiment our invention provides an aqueous structured surfactant composition comprising: water; sufficient surfactant to form a structure in the presence of electrolyte; a dissolved multivalent metal salt which desolubilises said surfactant, the concentration of said salt in said water being sufficient to form with said surfactant (i) an unstable and/or (ii) a flocculated spherulitic system having a viscosity greater than 0.8 Pa s; and a stabiliser comprising a compound which comprises a $C_{5-20}$ alkyl group and a hydrophilic group having a mass greater than 300 amu and provided with a plurality of ethoxylate, sulphonate, phosphonate, sulphate or phosphate groups, said stabiliser forming micelles in an aqueous solution of said polyvalent metal salt at said concentration, and said stabiliser being present in an amount sufficient to provide (i) a stable and/or (ii) a less viscous spherulitic composition respectively.

According to a tenth embodiment our invention provides an aqueous structured surfactant composition comprising: water; sufficient surfactant to form a structure in the presence of electrolyte; at least 10% by weight of an alkali metal or ammonium salt of a monovalent anion which salt desolubilises said surfactant, the concentration of said salt being sufficient to form with said surfactant (i) an unstable spherulitic system and/or (ii) a flocculated system having a viscosity greater than 0.8 Pa s; and a $C_{6-20}$ alkyl, alkenyl or alkaryl alkoxylate having at least 8 and preferably 25 to 75 ethyleneoxy groups and optionally up to ten propyleneoxy groups per molecule in an amount sufficient to form (i) a stable spherulitic composition and/or (ii) a less viscous spherulitic composition respectively.

According to an eleventh embodiment the invention provides a fabric conditioning composition comprising: water; a cationic fabric conditioner having two $C_{15-26}$ alkyl or alkenyl groups; sufficient of a flocculant to form with said fabric conditioner and water a viscous, flocculent and/or unstable system; and sufficient of a stabiliser having a $C_5$ to $_{25}$ hydrophobic group linked at one end to one end of at least on nonionic or cationic hydrophilic group having a mass greater than 300 amu and/or comprising at least five hydrophilic monomer units said stabiliser being capable of forming micelles in the presence of said water and said flocculent, to reduce the viscosity and/or degree of flocculation of, and/or stabilise said composition.

According to a twelfth embodiment the invention provides a surfactant composition comprising: water; a structure forming surfactant; sufficient dissolved electrolyte, if required, to form a structured surfactant system; sufficient of a dissolved, non-micelle-forming polymer to flocculate, raise the viscosity of, and/or destabilise said structured surfactant system and sufficient of said stabiliser to reduce the degree of flocculation and/or viscosity of, and/or stabilise said composition.

According to an thirteenth embodiment the invention provides a surfactant composition suitable for use in a suspension of a solid such as a pigment or pesticide and comprising: water; a structure-forming surfactant; any dissolved surfactant desolubiliser that may be required to form a structure with said surfactant water; sufficient of a non-micelle forming polyelectrolyte (e.g. a milling aid) to flocculate said structure; optionally, suspended particles of solid; and a stabiliser comprising a micelle forming compound having a $C_5$ to $_{25}$ alkyl group linked at one end to one end of at least one hydrophilic group, said hydrophilic group having a mass greater than 300 amu and/or being a polymer of more than four hydrophilic monomer units, in an amount sufficient to form a less flocculated structured surfactant composition.

According to a fourteenth embodiment the invention provides a liquid detergent composition comprising: water; a structure forming surfactant; sufficient dissolved electrolyte, if required, to form a structured surfactant system with said surfactant and water; suspended zeolite builder; an aminophosphinate of the formula:

$$RR'NCR'_2PO(OH)CR'_2NRR' \quad (I)$$

or polymers or oligomers with a repeating unit of the formula:

$$[—PO(OH)CR'_2NR(R''NR)_nCR'_2—] \quad (II)$$

wherein each of the R groups which may be the same or different is an optionally substituted alkyl, cycloalkyl, alkenyl, aryl, aralkyl, alkaryl or alkoxyalkyl group of 1–20 carbon atoms each of which may be optionally substituted once or more than once, and each of the R' groups, which may be the same or different, is hydrogen or an R group as herinbefore defined, R" is a divalent alkylene, cycloalkylene, alkarylene, alkylene group optionally interrupted by oxygen atoms or an arylene group and n is zero or an integer from 1 to 10, and polymers or oligomers thereof; said aminophosphinate being present in an amount sufficient to increase the viscosity of, flocculate or destabilise said system; and sufficient of said stabiliser to reduce the viscosity and/or degree of flocculation of and/or to stabilise the composition.

According to a fifteenth embodiment our invention provides a G-phase composition containing water, surfactant and, optionally, dissolved electrolyte and/or suspended solids, and adapted, in the absence of deflocculant, to form a mesophase-containing composition which separates into two or more portions on standing, and/or exhibits viscosity as herein defined of greater than 0.8 Pascal seconds and sufficient of a deflocculant such as said stabiliser to form a stable G-phas composition and/or a G-phase of reduced viscosity respectively.

According to a sixteenth embodiment our invention provides a clear, liquid, micellar solution containing water, surfactant and, optionally, dissolved electrolyte adapted in the absence of deflocculant to form a mesophase containing composition, and sufficient deflocculant such as said stabiliser to form a clear, $L_1$ micellar solution.

According to a seventeenth embodiment the invention provides a structured surfactant composition comprising: water; a structure-forming surfactant, comprising at least 30% by weight, based on the total surfactant, of non-ionic surfactant; and sufficient water soluble electrolyte to form a structured dispersion of an isotropic, liquid surfactant or surfactant/water phase in an anisotropic (e.g lamellar) continuous phase.

Preferably the isotropic surfactant/water phase is an $L_2$ phase. Alternatively said surfactant/water phase may comprise an $L_1$ phase.

According to an eighteenth embodiment the invention provides a structured surfactant composition comprising: water; a structure-forming surfactant comprising at least 30% by weight of non-ionic surfactant; and sufficient water soluble electrolyte to form a structured dispersion of an isotropic, liquid, surfactant or surfactant/water phase (eg: an $L_2$ phase) in an isotropic aqueous (e.g. in $L_1$) phase.

Preferably the novel phases in accordance with said seventeenth and eighteenth embodiments are stabilised by the presence of said stabiliser.

The Aqueous Medium

Some surfactants, especially very oil soluble surfactants such as isopropylamine alkyl benzene sulphonates are able to form flocculated, structured systems in water, even in the absence of electrolyte. In such instances the aqueous medium may consist essentially of water. However, most surfactants only flocculate in the presence of dissolved electrolyte, and in particular in highly concentrated solutions of electrolyte.

The compositions of our invention therefore typically contain high levels of dissolved surfactant desolubilising electrolyte. Typically the dissolved electrolyte is present in concentrations of greater than 10% e.g. greater than 14% especially more than 15% by weight, based on the weight of the formulation, up to saturation. For example sufficiently soluble electrolytes may be present at concentrations between 16 and 40%. The electrolyte solids may be present in excess of saturation, the excess forming part of the suspended solid.

The electrolyte may typically be one of four main types:

(i) Salts of multivalent anions:—Of these the preferred are potassium pyrophosphate potassium tripolyphosphate and sodium or potassium citrate.

Such electrolytes are generally preferred for detergent applications and in pesticides and pigment and dyebath formulations.

(ii) Salts of multivalent cations:—These are typically alkaline earth metal salts, especially halides. The preferred salts are calcium chloride and calcium bromide. Other salts include zinc halides, barium chloride and calcium nitrate. These electrolytes are preferred for use in drilling fluids as soluble weighting agents. Such salts are especially useful for completion and packing fluids, in which suspended solid weighting agents may be a disadvantage. They are also widely used in fabric conditioners.

(iii) Salts of monovalent cations with monovalent anions:—these include alkali metal or ammonium halides such as potassium chloride, sodium chloride, potassium iodide, sodium bromide or ammonium bromide, or alkali metal or ammonium nitrate. Sodium chloride has been found particularly useful in drilling fluids for drilling through salt bearing formations.

(iv) A polyelectrolyte:—These include non-micelle forming polyelectrolytes such as an uncapped polyacrylate, polymaleate or other polycarboxylate, lignin sulphonate or a naphthalene sulphonate formaldehyde copolymer. Such polyelectrolytes have a particularly highly flocculating effect on structured surfactants, even at low concentration. They may be deflocculated using said polyelectrolyte stabiliser or alkyl polyethoxylates, or alkyl polyglycosides.

Typically the greater the amount of surfactant present in relation to its solubility, the less electrolyte may be required in order to form a structure capable of supporting solid materials and/or to cause flocculation of the structured surfactant. We generally prefer to select electrolytes which contribute to the function of the composition, and where consistent with the above to use the cheapest electrolytes on economic grounds. The proportion of electrolyte added is then determined by the amount required to give adequate performance (e.g. in terms of washing performance in the case of detergents). Said stabiliser is then used to obtain the desired viscosity and stability.

However the electrolyte concentration may also depend, among other things, on the type of structure, and the viscosity required as well as considerations of cost and performance. We generally prefer to form spherulitic systems, for example, such as those described in our applications GB-A-2,153,380 and EP-A-0530708 in order to obtain a satisfactory balance between mobility and high payload of suspended solids. Such structures cannot normally be obtained except in the presence of certain amounts of electrolyte.

In addition to cost, choice of electrolyte may depend on the intended use of the suspension. Laundry products preferably contain dissolved builder salts. Compositions may contain auxiliary or synergistic materials as the electrolyte or part thereof. The selected electrolyte should also be chemically compatible with the substance to be suspended. Typical electrolytes for use in the present invention include alkali metal, alkaline earth metal, ammonium or amine salts including chlorides, bromides, iodides, fluorides, orthophosphates, condensed phosphates, such as potassium pyrophosphate or sodium tripolyphosphate, phosphonates, such as acetodiphosphonic acid salts or amino tris (methylenephosphonates), ethylene diamine tetrakis (methylene phosphonates) and diethylene triamine pentakis (mthylene phosphonates), sulphates, bicarbonate, carbonates, borates, nitrates, chlorates, chromates, formates, acetates, oxalates, citrates, lactates, tartrates, silicates, hypochlorites and, if required to adjust the pH, e.g. to improve the stability of the suspended solid or dispersed liquid or lower the toxicity, acids or bases such as hydrochloric, sulphuric, phosphoric or acetic acids, or sodium, potassium, ammonium or calcium hydroxides, or alkaline silicates.

Electrolytes which form insoluble precipitates with the surfactants or which may give rise to the formation of large crystals e.g. more than 1 mm on standing are preferably avoided, Thus, for example, concentrations of sodium sulphate above, or close to, its saturation concentration in the composition at 20° C. are undesirable. We prefer, therefore, compositions which do not contain sodium sulphate in excess of its saturation concentration at 20° C., especially compositions containing sodium sulphate below its saturation concentration at 15° C.

For cost reasons, we prefer to use sodium salts as electrolytes where possible although it is often desirable to include potassium salts in the electrolyte to obtain lower viscosities or higher electrolyte concentrations. Lithium and caesium salts have also been tested successfully, but are unlikely to be used in commercial formulations. Calcium salts such as calcium chloride or bromide have been used for drilling mud systems where their relatively high density is an advantage in providing weighting to the mud. Other bases such as organic bases, may be used, e.g. lower alkyl amines and alkanolamines including monoethanolamine, triethanolamine and isopropylamine.

In addition to or instead of dissolved electrolyte it is possible for the aqueous medium to contain dissolved amounts of a flocculating or destabilising non-electrolyte polymer in a quantity capable of flocculating and/or destabilising the surfactant. Examples include polyvinyl alcohol or polyethyl eneglycol.

The Stabiliser

We believe that said stabiliser acts, at least primarily as a flocculation inhibitor. We have observed particularly marked benefits from adding stabiliser to surfactant systems which are highly flocculated.

In the absence of said stabiliser it is often difficult to obtain a composition having precisely the right combination of rheological properties and washing performance. Either the composition is too viscous to pour easily, and clings to the cup, or else it is unstable and separates into two or more layers. The difficulty increases as the total concentration of surfactant and/or builder is increased. Commercial pressures for more concentrated liquid detergents have thus created a particular problem for formulators which the use of said stabiliser solves.

Preferably the concentration of surfactant and/or electrolyte is adjusted to provide a composition which, on addition of said stabiliser, is non-sedimenting on standing for three months at ambient temperature, and preferably also at 0° C. or 40° C. or most preferably both. Preferably also the concentrations are adjusted to provide a shear stable composition and, desirably, one which does not increase viscosity substantially after exposure to normal shearing. It is sometimes possible to choose the concentration of surfactant and electrolyte so as to obtain the above characteristics in the absence of said stabiliser, but at a high viscosity. Said stabiliser is then added in order to reduce the viscosity.

We prefer that compositions according to the invention should comprise between 0.005 and 20%, preferably 0.01 to 5% by weight especially 0.05% to 2%, based on the weight or the composition of said stabiliser.

Where the electrolyte has a multivalent anion, e.g. a citrate or pyrophosphate, and the surfactant is anionic or nonionic we prefer that the hydrophilic portion of the stabiliser has a plurality of carboxy and/or hydroxy groups, e.g. especially an alkyl ether polycarboxylate, alkyl polyglycoside, alkyl polyglycamide and/or said polyelectrolyte stabiliser.

Where the electrolyte comprises a multivalent cation we prefer to use stabilisers with a plurality of ethoxylate, hydroxyl, sulphonate, phosphonate, sulphate or phosphate groups such as higher alkyl polyethoxylate, polyvinyl alcohol, alkyl polyglycoside, alkyl polyvinylsulphonate, alkyl poly (2,2- acrylamidomethylpropan sulphonate), sulphated alkyl polyvinyl alcohol, polysulphonated alkyl polystyrene, alkyl polyvinyl phosphonate, alkyl polyvinyl phosphate, or a poly (vinylsulphonated) alkyl polyalkyoxylate.

Where the electrolyte is an alkali metal halide or similar monovalent system we prefer to use alkyl ethoxylate having, preferably, more than 7 especially more than 10 typically more than 20, e.g. 25 to 75 especially 30 to 60 most preferably 40 to 55 ethoxy groups.

Compositions according to the present invention may contain one or mare of said stabilisers.

The stabilisers for use according to our invention are characterised by being surfactants having a hydrophilic portion and a hydrophobic portion. The hydrophobic portion normally comprises a $C_{5-25}$ alkyl or alkenyl group, preferably a $C_6$ to $_{25}$ e.g. a $C_{8-20}$ alkyl or alkenyl group, e.g. a straight chain alkyl group. Alternatively the hydrophobic portion may comprise an aryl, alkaryl, cycloalkyl, branched chain alkyl, alkyl polypropyleneoxy or alkyl poly butyleneoxy group. In certain instances it may be possible or preferred to use a amyl groups as the hydrophobic portion. The hydrophilic portion requires to be comparatively large, and is preferably furnished with a plurality of hydrophilic functional groups such as hydroxyl or carboxylate groups or sulphonate.

The required size of the hydrophilic portion is indicated by the fact that alkyl glycosides with one or two glycoside residues or ethoxylates with three ethoxylate residues are not normally effective while those with three, four, five, six and seven or more glycoside residues are progressively more effective. Ethoxylates with five, six seven or eight ethoxylate residues similarly appear to be progressively more effective in those aqueous media in which they are soluble. Alkyl polyglycosides with a degree of polymerisation greater thin about 1.2, preferably more than 1.3, which have a broad distribution and therefore contain significant amounts of higher glycosides are thus useful, the effectiveness increasing with increasing degree of polymerisation. However alkyl polyglycoside fractions consisting essentially of diglycoside e.g. maltosides, triglycoside or even tetraglycoside were found to be less effective than mixtures containing small amounts of higher oligomers. A fraction consisting substantially of heptaglycoside, however, was very effective, and comparable to the optimum examples of said polyelectrolyte stabiliser, in concentrated sodium citrate solutions. Alkyl polyglycosides with two residues have been found to have a small deflocculant effect in systems containing very high concentrations of electrolyte, e.g. 40%. The effect increases with increasing degree of polymerisation, more than four e.g seven glycoside residues being required for complete effectiveness, depending upon electrolyte concentration. Larger minimum degrees of polymerisation are required at lower concentration. This may be a function of the effect of the electrolyte concentration on the interlamellar spacing of the spherulite, which in turn determines how much of the stabiliser is confined to the surface of the spherulite.

Alkyl ether polycarboxylates with one to three ethylene oxide residues and an average of 2 to 3 carboxy groups per molecule are relatively ineffective while carboxylates with more than three especially more than eight ethylene oxide residues and more than 4 especially more than 8 carboxy groups are generally more effective. For example, an eleven mole ethoxylate with 10 or more carboxy groups is very effective in citrate solution.

Glucose esters are generally not effective, but some effect is observed in concentrated solutions of electrolyte with maltose esters. Oligosaccharlde esters such as maltopentaose or higher oligosaccharide, e.g. esters of partially hydrolysed starch, are useful.

In systems such as 25% potassium chloride higher thoxylates such as 7 to 80 mole e.g. 20 to 50 mole ethoxylates are very effective but lower ethoxylates such as 3 mole ethoxylate are relatively ineffective.

In general the effectiveness of polymeric surfactants seems to depend more on the proportion of higher (e.g. having a hydrophylic group with mass greater than 1000 amu or polymers greater than the tetramer) components than on the mean degree of polymerisation of the hydrophilic portion of the surfactant.

One way of determining whether a particular compound exhibits the necessary solubility is to measure its solubility in a concentrated aqueous electrolyte solution, preferably the electrolyte which is present in the composition, or one which is equivalent in its chemical characteristics.

The stabilisers which are effective generally form micelles in a solution of the electrolyte, and any other flocculent present in the formulation, in water in the same relative proportions as in the composition. We have detected micelle formation by shaking a suitable amount of a prospective stabiliser (e.g. 3% by weight based on the weight of the test solution) with aqueous electrolyte test solution and an oil soluble dye. The mixture may be separated (e.g. by centrifuging) to form a clear aqueous layer and the colour of the aqueous layer is noted. If the aqueous layer is colourless then micelle formation has been negligible. If a colour develops then the presence of micelles is indicated and the candidate will usually be found to be a good stabiliser for systems containing similar concentrations of the same electrolyte.

For example in the case of citrate built liquid detergents or similar systems in which the electrolyte consists at least predominantly of compounds with multivalent anions, a convenient electrolyte is potassium citrate such as a solution containing 15% by weight to saturation of potassium citrate e.g. 16 to 18%. The solubility of the stabiliser in the test solution is usually at least 1% preferably at least 2% more preferably at least 3%, most preferably at least 5% by weight. For instance a test may be based on adding sufficient concentrated e.g. greater than 30% aqueous solution of the stabiliser to a solution of 18% potassium citrate in water to provide 1 or 5% by weight of the stabiliser in the final solution, or to give evidence of micelles by the foregoing dye test.

Without wishing to be limited by any theory we believe that the hydrophobic part of the stabiliser may be incorporated in the outer bilayer of a spherulite and the hydrophilic portion may be sufficiently large to project beyond the spherulite surface preventing flocculation, provided that it is sufficiently soluble in the surrounding aqueous medium.

A feature of the stabilisers of our invention is the essentially end to end orientation of the hydrophobic and hydrophilic parts. This typically provides an essentially linear architecture, typical of a classic surfactant with a (usually) essentially linear hydrophilic polymeric group capped, at one end, by a hydrophobic group. This contrasts with the comb like architecture inphasised by the prior art on deflocculation in which hydrophilic chains have a plurality of hydrophobic side chains or vice versa. We believe that the surfactant stabilisers according to our invention give a more effective deflocculation, as well as contributing to the overall surfactancy of the composition. We do not exclude surfactants in which the hydrophilic portion is branched e.g. the other polycarboxylates, nor do we exclude branched hydrophobic groups such as branched chain or secondary alkyl groups, nor do we exclude compounds with more than one hydrophilic group as for example ethoxylated diethanolamides. However the essential architecture is of a single hydrophobic group joined at one end only to one or more hydrophilic group in an end to end orientation.

The stabiliser preferably has a critical micellar concentration, (as % weight for weight in water at 25° C.) of less than 0.5 more preferably less than 0.4, especially less than 0.35 more particularly less than 0.3. We particularly prefer stabilisers having a critical micellar concentration greater than $1\times10^{-5}$.

Preferably the stabiliser is able to provide a surface tension of from 20 to 50 mN $m^{-1}$ e.g. 28 to 38 mN $m^{-1}$.

The stabiliser must be compatible chemically with the surfactant to be deflocculated. Typically anionic based stabiltsers are unsuitable for use as deflocculants of cationic surfactant structures and cationic based stabilisers cannot be used to deflocculate anionic based surfactant structures. However nonionic based stabilisers are compatible with both anionic and cationic surfactant types.

Said stabiliser is typically a compound of the general formula RXA wherein R is a $C_{5-25}$ alkyl, alkaryl or alkenyl group. X represents O, $CO_2$, S, $NR^1$, $PO_4R^1$, or $PO_3R^1$ where $R^1$ is hydrogen or an alkyl group such as $C_1$ to $_4$ alkyl or an A group, and A is a hydrophilic group e.g. comprising a chain of more than 4 monomer units, linked at one end to X, which chain is sufficiently hydrophilic to confer on the stabiliser the ability to form micellar solutions (especially solutions containing greater than 5% by weight, based on the total weight of the solution), in an aqueous solution of the electrolyte present in the system to be deflocculated at its concentration in the system relative to the water content. Products which are only partially soluble in the electrolyte solution may be used. Any insoluble fraction will contribute to the total surfactancy while the soluble fraction will additionally function as said stabiliser. A may for example be a polyelectrolyte group, or polyglycoside group, a polyvinyl alcohol group or a polyvinyl pyrrolidone group or a polyethoxylate, having at least six monomer groups.

Polyelectrolyte Stabilisers

Said polyelectrolyte stabilisers are preferably represented by (I):

$$R—X—[CZ_2—CZ_2]_nH \quad (I)$$

Wherein R and X have the same significance as before, at least one Z represents a carboxylate group COOM where M is H or a metal or base such that the polymer is water soluble any other Z being H or a $C_1$ to 4 alkyl group and n=1 to 100, preferably 5 to 50, most preferably 10 to 30.

The alkyl or alkenyl group R preferably has from 8 to 24, more preferably 10 to 20 especially 12 to 18 carbon atoms. R may be a straight or branched chain primary alkyl or alkenyl group such as a cocoyl, lauryl, cetyl, stearyl, patmityl, hexadecyl, tallowyl, oleyl, decyl, linolyl, dodecyl or linolenyl group. R may alternatively be a $C_{6-18}$ alkyl phenyl group.

The ratio of the hydrophobic moiety to the hydrophilic moiety in the stabilisers (I) should preferably be sufficient to ensure that the polymer is soluble in saturated sodium carbonate solution.

Said polyelectrolyte stabilisers are therefore preferably linear, watr-soluble, end stopped polyacrylates, polymaleates, polymethacrylates or polycrotonates comprising a hydrophobic moiety (R) and at least one hydrophilic moiety $[CZ_2—CZ_2]$. Copolymers, e.g. acrylate/maleate copolymers may also be used.

The acrylic or maleic acid monomer units may be present as the neutralised salt, or as the acid form, or a mixture of both. Preferably the acrylic acid monomer units are neutralised with sodium. Alternatively they may be noutralised with potassium, lithium, ammonium, calcium or an organic base.

The hydrophobic and hydrophilic portions of said polyelectrolyte stabiliser are preferably linked by a sulphur atom i.e. the polymer is preferably capped with a thiol.

For the surfactants represented by (I) it is preferred that the weight average mass of such surfactants is greater than 250 amu, preferably greater than 500 and most preferably is greater than 1000 amu.

Typically said polyelectrolyte stabiliser is present in the aqueous based surfactant compositions as provided by the invention at levels between 0.01 and 5% by weight, preferably at levels between 0.05 and 3% by weight, eg. 0.1 and 2% by weight based on the total weight of the composition.

Typically, said polyelectrolyte stabilisers (I) are produced according to the following method;

The hydrophilic monomer eg acrylic acid, and the hydrophobic chain terminator, e.g. hexadecane thiol are reacted together in a suitable ratio, preferably from 90:10 to 50:50 e.g. 70:30 to 80:20 in the presence of a solvent e.g. acetone and a free radical initiator e.g. azobisisobutyronitrile until the polymerisation reaction is complete e.g. by refluxing for approximately 2 hours. On completion of the reaction the solvent is removed e.g. by rotary evaporation, and the resultant polymer product is neutralised by the addition of a base e.g. NaOH solution to produce (I).

Alkyl Ether Polcarboxylates

Said stabiliser may alternatively be a polycarboxylated polyalkoxylate of general formula (I):

$$(I): R(R^1)_x [R^2(R^3)_z H]_y R^4$$

in which R is a straight or branched chain alkyl, alkaryl or alkenyl group or straight or branched chain alkyl or alkenyl carboxyl group, having in each case, from 6 to 25 carbon atoms, each $R^1$ is an $OCH_2CH_2$ or an $OCH(CH_3)CH_2$ group, each $R^2$ is an $OC_2H_3$ or $OC_3H_5$ group, each $R^3$ is a $C(R^5)_2C(R^5)_2$ group, wherein from 1 to 4, preferably 2, $R^5$ groups per $R^3$ group are $CO_2A$ groups, each other $R^5$ group being a $C_1$–$C_2$ alkyl, hydroxy alkyl or carboxyalkyl group or, preferably H, $R^4$ is OH, $SO_4B$, $SO_3B$, OR, sulphosuccinyl, $OCH_2CO_2B$, or $R^6{}_2NR^7$, $R^6$ is a $C_1$–$C_4$ alkyl or hydroxyalkyl group, $R^7$ is a $C_1$–$C_{20}$ alkyl group, a benzyl group a $CH_2CO_2B$, or →0 group or $PO_4B_2$, B is a cation capable of farming water soluble salts of said carboxylic acid such as an alkali metal or alkaline earth metal, each z is from 1 to 5 preferably 1, y is at least 1 and (x+y) has an average value of from 1 to 50, wherein the $R^1$ and $R^2$ groups may be arranged randomly or in any order along the polyalkoxylate chain.

For example we prefer to use an alkyl ether polycarboxylate such as those obtained by addition of at least one, preferably more than two e.g. three to thirty males of unsaturated carboxylate acid or its salts, such as itaconic, fumaric or preferably maleic acid to an alkyl polyethoxylate such as a polyethoxylated alcohol or fatty acid, e.g. using a free radical initiator.

For example an aqueous solution of a polyethoxy compound, such as a polyethoxylated alcohol, and the sodium salt of an unsaturated acid such as sodium maleate may be heated in the presence of a peroxy compound such as dibenzoylporoxide, Other carboxylic acids which may be used include acrylic, itaconic, aconitic, angelic, methacrylic, fumaric, and tiglic.

Preferably such polycarboxylates have a "backbone" comprising from 2 to 50, more preferably 3 to 40, e.g. 5 to 30, especially 8 to 20 ethylene oxy groups, and a plurality of side chains each comprising, for example, a 1,2-dicarboxy ethyl, 1,2,3,4-tetracarboxy butyl or higher teleomeric derivative of the carboxylic acid. Preferably said alkyl ether polycarboxylate has at least four more preferably at least six, e.g. eight to fifty carboxyl groups.

Alkyl Polyglycosides

Said stabillser may alternatively be an alkyl polyglycoside. Alkyl polyglycosides are the products obtained by alkylating reducing sugars such as fructose or, preferably, glucose, typically by reacting with fatty alcohol in the presence of a sulphonic acid catalyst or by transetherification of a lower alkyl polyglycoside such as a methyl, ethyl, propyl or butyl polyglycoside with a $C_{6-25}$ alcohol. We do not however exclude the use of amyl polyglycosides. The degree of polymerisation of the glycoside residue depends on the proportion of alcohol and the conditions of the reaction, but is typically from 1.2 to 10. For our invention we prefer alkyl polyglycosides having a degree of polymerisation greater than 1.3 more preferably greater than 1.5 especially greater than 1.7 e.g. 2 to 20. We particularly prefer alkyl polyglycosides containing a significant proportion of material with more than four units.

Polyalkoxylates

Alkyl polyalkoxylates such as $C_8$ to $_{20}$ alkyl polyethoxylates, or mixed thoxylate/propoxylates may be used as said stabilisers, especially in dilute polyelectrolytes or concentrated alkali or alkaline earth salts of monovalent anions e.g. halides or nitrates. Apart from alkoxylated alcohols other polyalkoxylates having a $C_{6-20}$ alkyl group such as ethoxylated carboxylic acids, ethoxylated fatty amines, alkyl glyceryl ethoxylates, alkyl sorbitan ethoxylates, ethoxylated alkyl phosphates or thoxylated mono or diethanolamides may be used.

Generally we prefer alkoxylates having more than six e.g. more than seven especially more than eight ethyleneoxy groups. We particularly prefer ethoxylates having from ten to sixty e.g. twelve to fifty ethyleneoxy groups. Propyleneoxy groups if present are normally part of the hydrophobic group, e.g. in an alkyl propyleneoxy group. However propylenoxy groups may also occur with ethylnoxy groups in the hydrophilic part of the stabiliser, (e.g. in a random copolymer) provided they do not render it insoluble in the aqueous phase of the system to be deflocculated.

Typically this requires that the propyleneoxy groups constitute less than 50% of the total number of alkyleneoxy groups in the hydrophilic part of the stabiliser, e.g. less than 30% usually less than 20%.

Generally we prefer that the hydrophilic part of the molecule contain fewer than 8 propyleneoxy groups, e.g. less than four.

Other Stabilisers

Said stabiliser may alternatively be an alkyl or alkyl thiol capped polyvinyl alcohol or polyvinyl pyrrolidone. Alternatively an alcohol or carboxyllc acid may be reacted with epihalohydrin to form an alkyl poly epihalohydrin and the product hydrolysed e.g. with hot aqueous alkali. Glycolipids (sugar esters) and in particular di or oligosaccharide esters such as sucrose stearate or maltopentaose palmitate are also useful as said stabilisers, as are alkyl polysulphomaleates. Other potentially useful stabilisers include alkyl ether carboxylates, alkyl other sulphates, alkylether phosphates, alkyl polyvinyl sulphonates, alkyl poly (2-acrylamido-2-methylpropane sulphonates) and quaternised alkly amido polyalkyleneamines such as a quaternised alkylamido penta ethylene hexamine.

Addition of Said Stabiliser

Said stabiliser is generally more effective at preventing flocculation than at deflocculating an already flocculated formulation. However, when the stabiliser is added to the surfactant prior to the electrolyte we have sometimes observed significant subsequent change of viscosity on storage. We therefore prefer to add at least the majority of said stabiliser after the electrolyte. It is usually desirable to add at least a small proportion of the stabiliser initially in order to maintain sufficient mobility to mix the ingredients, but the amount added initially is preferably kept to the minimum required to provide a mixable system. We prefer, however, to add the balance of the electrolyte as soon as practicable after the addition of the electrolyte.

Viscosity

Aqueous based concentrated, structured or mesophase-containing, surfactant compositions provided by the present invention in the absence of said stabiliser are typically unstable, highly viscous, or immobile and are unsuitable for use as, e.g., detergent compositions or solid suspending media. Viscosities of greater than 4 Pa s, as measured by a Brookfield RVT viscometer, spindle 5, 100 rpm at 20° C., are not uncommon for some such compositions, others separate on standing into a relatively thin aqueous layer and a relatively viscous layer containing a substantial proportion of the surfactant, together, sometimes, with other layers depending upon what additional ingredients are present.

The aqueous based structured surfactant compositions according to the present invention preferably have a viscosity at 21 $s^{-1}$ shear rate, or at the viscometry conditions described above, of not greater than 2 Pa s, preferably not greater than 1.6 Pa s. Surfactant compositions exhibiting a viscosity of not greater than 1.4 Pa s are especially preferred. Generally we aim to provide compositions with a viscosity less than 1.2 Pa s especially less than 1 Pa s e.g. less than 0.8 Pa s.

The surfactant compositions of the invention, in practice, usually have a viscosity under the conditions as hereinabove described, above 0.3 Pa s, e.g. above 0.5 Pa s.

Ideally, for consumer preferred detergent products the viscosity of compositions according to the present invention, as determined above is between 0.7 and 1.2 Pa s in order to exhibit the required flow characteristics.

Surfactant

Compositions according to the present invention generally contain at least sufficient surfactant to form a structured system. For some surfactants this may be as low as 2% by weight, but more usually requires at least 3% more usually at least 4% typically more than 5% by weight of surfactant.

Detergent compositions of the present invention preferably contain at least 10% by weight of total surfactant based on the total weight of the composition, most preferably at least Z0% especially more than 25% e.g. more than 30%. It is unlikely in practice that the surfactant concentration will exceed 80% based on the weight of the composition. Said stabiliser is a part of the total surfactant.

The amount of surfactant present in the composition is preferably greater than the minimum which is able, in the presence of a sufficient quantity of surfactant-desolubilising electrolyte, to form a stable, solids-suspending structured surfactant system.

The surfactant may comprise anionic, cationic, non-ionic, amphoteric and/or zwltterlontc species or mixtures thereof.

Anionic surfactant may comprise a $C_{10-20}$ alkyl benzene sulphonate or an alkyl ether sulphate which is preferably the product obtained by ethoxylating a natural fatty or synthetic $C_{10-20}$ e.g. a $C_{12-14}$ alcohol with from 1 to 20, preferably 2 to 10 e.g. 3 to 4 ethyleneoxy groups, optionally stripping any unreacted alcohol, reacting the ethoxylated product with a sulphating agent and neutralising the resulting alkyl ether sulphuric acid with a base. The term also includes alkyl glyceryl sulphates, and random or block copolymerised alkyl ethoxy/propoxy sulphates.

The anionic surfactant may also comprise, for example, $C_{10-20}$ eg. $C_{12-18}$ alkyl sulphate.

The surfactant may preferably comprise a $C_{8-20}$ e.g. $C_{10-18}$ aliphatic soap. The soap may be saturated or unsaturated, straight or branched chain.

Preferred examples include dodecanoates, myristates, stearates, oleates, linoleates, linolenates and palmitates and coconut and tallow soaps. Where foam control is a significant factor we particularly prefer to include soaps eg, ethanolamine soaps and especially monothanolamine soaps, which have been found to give particularly good cold storage and laundering properties.

According to a further embodiment, the soap and/or carboxylic acid is preferably present in a total weight proportion, based on the total weight of surfactant, of at least 20% more preferably 20 to 75%, most preferably 25 to 50%, e.g. 29 to 40%.

The surfactant may include other anionic surfactants, such as olefin sulphonates, paraffin sulphonates, taurides, isethionates, ether sulphonates, ether carboxylates, aliphatic ester sulphonates eg, alkyl glyceryl sulphonates, sulphosuccinates or sulphosuccinamates. Preferably the other anionic surfactants are present in total proportion of less than 45% by weight, based on the total weight of surfactants, more preferably less than 40, most preferably less than 30% e.g. less than 20%.

The cation of any anionic surfactant is typically sodium but may alternatively be potassium, lithium, calcium, magnesium, ammonium, or an alkyl ammonium having up to 6 allphatic carbon atoms including isopropylamonium, monothanolammonium, diethanolammonium, and triethanolammonium.

Ammonium and ethanolammonium salts are generally more soluble than the sodium salts. Mixtures of the above cations may be used.

The surfactant preferably contains one, or preferably more, non-ionic surfactants. These preferably comprise alkoxylated $C_{8-20}$ preferably $C_{12-18}$ alcohols. The alkoxylates may be othoxylates, propoxylates or mixed ethoxylated/propoxylated alcohols. Particularly preferred are ethoxylates with 2 to 20 especially 2.5 to 15 ethyleneoxy groups.

The alcohol may be fatty alcohol or synthetic e.g. branched chain alcohol. Preferably the non-ionic component has an HLB of from 6 to 16.5, especially from 7 to 16 e.g. from 8 to 15.5. We particularly prefer mixtures of two or more non-ionic surfactants having a weighted mean HLB in accordance with the above values.

Other ethoxylated and/or propoxylated non-ionic surfactants which may be present include $C_{6-16}$ alkylphenol alkoxylates, alkoxylated fatty acids, alkoxylated amines, alkoxylated alkanolamides and alkoxylated alkyl sorbitan and/or glyceryl esters.

Other non-ionic surfactants which may be present include amine oxides, fatty alkanolamides such as coconut monoethanolamide, and coconut diethanolamide and alkylaminoethyl fructosides and glucosides.

The proportion by weight of non-ionic surfactant is preferably at least 2% and usually loss than 40% more typically less that 30% eg, 3 to 25% especially 5 to 20% based on total weight of surfactant. However compositions wherein the non-ionic surfactant is from 40 to 100% of the total weight of the surfactant are included and may be preferred for some appilcations.

The surfactant may be, or may comprise major or minor amounts of, amphotertc and/or cationic surfactants, for example betaines, imidazolines, amidoamines, quaternary ammonium surfactants and especially cationic fabric conditioners having two long chain alkyl groups, such as tallow groups. Examples of fabric conditioners which may be deflocculated according to our invention include ditallowyl dimethyl ammonium salts, ditallowyl methyl benzylammonium salts, ditallowyl imidazolines, ditallowyl amidoamins and quaternised ditallowyl imidazolines and amidoamines. The anion of the fabric conditioner may for instance be or may comprise methosulphate, chloride, sulphate, acetate, lactate, tartrate, citrate or formate. We prefer that the compositions of our invention do not contain substantial amounts of both anionic and cationic surfactants.

Aminophosphinates

A particular feature of the invention is its use to stabilise structured liquid detergent compositions containing suspended zeolite and an aminophosphinate cobuilder.

The cobuilder may comprise compounds which have the formula:

$$RR'NCR'_2PO(OH)CR'_2NRR' \quad (I)$$

or polymers or oligomers with a repeating unit of the formula:

$$[—PO(OH)CR'_2NR(R''NR)_nCR'_2—] \quad (II)$$

wherein each of the R groups which may be the same or different is an optionally substituted alkyl, cycloalkyl, alkenyl, aryl, aralkyl, alkaryl or alkoxyalkyl group of 1–20 carbon atoms each of which may be optionally substituted once or more than once, and each of the R' groups, which may be the same or different, is hydrogen or an R group as hereinbefore defined, R" is a divalent alkylene, cycloalkylene, alkarylene, alkylene group optionally interrupted by oxygen atoms or an arylene group and n is zero or an integer from 1 to 10, and polymers or oligomers thereof. All functional groups resident upon R,R' or R" should not irreversibly decompose in the presence of a carbonyl compound or hyphophosphorous acid or inorganic acid.

The cobuilder may be a polymeric or oligomeric amino phosphinate with repeating units of formula (II) or a compound of formula (I), in which R contains at least one phosphorus or sulphur atom. It may be derived from lysine, 1-amino sorbitol, 4-amino butyric acid or 6-amino caproic acid. The polymeric or oligomeric phosphinates may have a mass corresponding to as few as 2 units of formula (II), or as many as 1000 e.g. 200, for example they may have masses as low as 244 amu or as high as 100,000 amu or more such as 500,000 amu.

The phosphinates may be in the form of free acids or in the form of at least partly neutralised salts thereof. The cations are preferably alkali metal ions, preferably sodium or alternatively potassium of lithium, but may be other monovalent, divalent or trivalent cations such as ammonium and organic substituted ammonium, (including quaternary ammonium), such as triethyl- or triethanolammonium, quaternary phosphonium such as tetrakis hydroxymethyl phosphonium, alkaline earth such as calcium and magnesium or other metal ions such as aluminium. Preferably the salts or partial salts are water soluble e.g. with solubility in water at 20° C. of at least 10 g/l especially at least 100 g/l.

The R' groups are preferably all hydrogen atoms. Alternatively they may independently be alkyl e.g. methyl or ethyl, aryl e.g. phenul or tolyl, cycloalkyl, aralkyl e.g. benzyl, alkoxyalkyl e.g. alkoxyhexyl or these groups optionally substituted at least once or at least twice such as substituted alkyl e.g. haloalkyl, carboxyalkyl or phosphonoalkyl, substituted aryl e.g. hydroxyphenyl or nitrophenyl.

Preferably the R groups represent substituted alkyl e.g. ethyl or methyl, or aryl e.g. phenyl or tolyl groups, or heterocycles such as thiazole or triazole groups, and especially at least one and preferably all represent groups which carry one or more functional groups capable of coordinating to metal ions, such as carbonyl, carboxyl, amino, imino, amido, phosphonic acid, hydroxyl, sulphonic acid, arsenate, inorganic and organic esters thereof e.g. sulphate or phosphate, and salts thereof. The phosphinates may carry a number of different R groups, as is the case if more than one amine is added to the reaction mixture from which they are isolated.

The preferred phosphinates for use as cobuilders are those in which at least one of the R groups carries at least one carboxylic acid substituent, for example $—C_6H_4COOH$, but especially a carboxyalkyl group containing 2 to 12 carbon atoms e.g. $—CH_2COOH$ when the phosphinate is synthesised using glycine, $—CH(COOH)CH_2COOH$ when the phosphinate is synthesised using aspartic acid or $—CH(COOH)CH_2CH_2COOH$ when the phosphinate 15 synthesised using glutamic acid.

The phosphinates may be optically active e.g. as in the case of examples in which at least one of the R, R' or R" groups is chiral or when the two R' groups on one or more of the carbon atoms in (I) or (II) are non-identical. The arrangements of the substituents around each chiral centre may be of either configuration. If desired racemic mixtures may be separated into optical isomers by means known per se.

The phosphinates may be formed by allowing hypophosphorous acid to react with an amine in the presence of a carbonyl compound which is either a ketone or an aldehyde or a mixture thereof and an inorganic acid. The hypophosphorous acid may be added to the reaction as the acid or as a salt thereof e.g. sodium hypophosphite. The reaction is accompanied by the evolution of water.

The preparation of the cobuilder is described in more detail in EP-0 419 264.

The level of cobuilder in structured liquid surfactants is normally restricted to less than about 2% by weight or lower, by its tendency to destabilise the structured surfactant. By use of said stabiliser it is possible to incorporate substantially greater amounts of cobuilder, e.g. up to 10%, preferably 2 to 8% e.g. 3 to 6% by weight based on the total weight of the composition.

The formulations thus comprise: structured surfactants (e.g. 5 to 50% by weight); enough dissolved electrolyte, where required, to form a structure (preferably spherulitic); suspended zeolites (e.g. 10 to 40% by weight); a quantity of the aminophosphinate cobuilder sufficient to cause flocculation or instability of the structured surfactant (e.g. 3 to 8% by weight); and enough of said stabiliser to reduce the flocculation of, or stabilise the formulation (e.g. 0.01 to 3% by weight).

Suspended Solids

A major advantage of the preferred compositions of the invention is their ability to suspended solid particles to provide non-sedimenting pourable suspensions.

Optionally the composition may contain up to, for example, 80% by weight, based on the weight of the composition, of suspended solids, more usually up to 30 e.g. 10 to 25%. The amount will depend on the nature and intended use of the composition. For example in detergent compositions it is often desired to include insoluble builders such as zeolite or sparingly soluble builders such as sodium tripolyphosphate which may be suspended in the structured surfactant medium.

The surfactant systems according to our invention may also be used to suspend: abrasives such as talc, silica, calcite or coarse zeolite to give hard surface cleaners; or pesticides, to provide water dispersible pourable compositions containing water-insoluble pesticides, without the hazards of toxic dust or environmentally harmful solvents. They are useful in providing suspensions of pigments, dyes, pharmaceuticals, biocides, or as drilling muds, containing suspended shale and/or weighting agents such as sodium chloride, calcite, barite, galena or haematite.

They may be used to suspend exfoliants including talc, clays, polymer beads, sawdust, silica, seeds, ground nutshells or diacalcium phosphate, pearlisers such as mica, glycerol mono- or di-stearate or ethylene glycol mono- or di-stearate, natural oils, such as coconut, evening primrose, groundnut, meadow foam, apricot kernel, avocado, peach kernel or jojoba oils, synthetic oils such as silicone oils, vitamins, anti-dandruff agents such as zinc omadine, and selenium disulphide, proteins, emollients such as lanolin or isopropylmyristate, waxes and sunscreens such as titanium dioxide and zinc oxide.

Builders

We prefer that detergent compositions of our invention contain dissolved builders and/or suspended particles of solid builders, to provide a fully built liquid detergent. "Builder" is used herein to mean a compound which assists the washing action of a surfactant by ameliorating the effects of dissolved calcium and/or magnesium. Generally builders also help maintain the alkalinity of wash liquor. Typical builders include sequestrants and complexants such as sodium tripolyphosphate, potassium pyrophosphate, trisodium phosphate, sodium ethylene diamine tetracetate, sodium citrate or sodium nitrilo-triacetate, ion exchangers such as zeolites and precipitants such as sodium or potassium carbonate and such other alkalis as sodium silicate. Said stabiliser also contributes to the total builder. The preferred builders are zeolite and sodium tripolyphosphate. The builder may typically be present in concentrations up to 50% by weight of the composition e.g. 15 to 30%.

pH

The pH of a composition for laundry use is preferably alkaline, as measured after dilution with water to give a solution containing 1% by weight of the composition, e.g. 7 to 12, more preferably 8 to 12, most preferably 9 to 11.

Hydrotropes

Compositions of our invention may optionally contain small amounts of hydrotropes such as sodium xylene sulphonate, sodium toluene sulphonate or sodium cumene sulphonate, e.g in concentrations up to 5% by weight based on the total weight of the composition, preferably not more than 2%, e.g. 0.1 to 1%. Hydrotropes tend to break surfactant structure and it is therefore important not to use excessive amounts. They are primarily useful for lowering the viscosity of the formulation, but too much may render the formulation unstable.

Solvents

The compositions may contain solvents, in addition to water. However, like hydrotropes, solvents tend to break surfactant structure. Moreover, again like hydrotropes, they add to the cost of the formulation without substantially improving the washing performance. They are moreover undesirable on environmental grounds and the invention is of particular value in providing solvent-free compositions. We therefore prefer that they contain less than 6%, more preferably less than 5% most preferably less than 3%, especially less than 2%, more especially less than 1%, e.g. less than 0.5% by weight of solvents such as water miscible alcohols or glycols, based on the total weight of the composition. We prefer that the composition should essentially be solvent-free, although small amounts of glycerol and propylene glycol are sometimes desired. Concentrations of up to about 3% by weight, e.g. 1 to 2% by weight of ethanol are sometimes required to enhance perfume. Such concentrations can often be tolerated without destabilising the system.

Polymers

Compositions of our invention may contain various polymers. In particular it is possible to incorporate useful amounts of polyelectrolytes such as uncapped polyacrylates or polymaleates. Such polymers may be useful because they tend to lower viscosity and because they have a detergent building effect and may have anticorrosive or antiscaling activity. Unfortunately they also tend to break surfactant structure and cannot normally be included in structured surfactants in significant amounts without destabilising the system, We have discovered that relatively high levels of polyelectrolytes can be added to structured detergents in conjunction with said stabiliser, without destabilising the structure. This can provide stable products of even lower viscosity than can be achieved with said stabiliser alone.

Some examples of polymers which may be included in the formulation are antiredeposition agents such as sodium carboxymethyl cellulose, antifoams such as silicone antifoams, enzyme stabilisers such as polyvinyl alcohols and polyvinyl pyrrolidone, dispersants such as lignin sulphonates and encapsulents such as gums and resins. We have found that milling aids such as sodium dimethylnapthalone sulphonate/formildehyde condensates are useful where the solid suspended in the composition requires milling as in the case of dye or pesticide formulations, The amount of polymer added depends on the purpose for which it is used. In some cases it may be as little as 0.01% by weight, or even lower. More usually it is in the range 0.1 to 10%, especially 0.2 to 5% e.g. 0.5 to 2% by weight.

Other Detergent Additives

The solid-suspending detergent compositions of our invention may comprise conventional detergent additives such as antiredeposition agents (typically sodium carboxymethyl cellulose), optical brighteners, sequestrants, antifoams, enzymes, enzyme stabilisers, preservatives, dyes, pigments, perfumes, fabric conditioners, e.g. cationic fabric softeners or bentonite, opecifiers, bleach activators and/or chemically compatible bleaches. We have found that peroxygen bleaches such as sodium perborate, especially bleaches that have been protected e.g. by encapsulation, are more stable to decomposition in formulations according to our invention than in conventional liquid detergents. Generally all conventional detergent additives which are dispersible in the detergent composition as solid particles or liquid droplets, in excess of their solubility in the detergent, and which are not chemically reactive therewith may be suspended in the composition.

Applications

In addition to providing novel laundry detergents, fabric conditioners and scouring creams the stabilised structured surfactants of our invention may be used in toiletries, including shampoos, liquid soaps, creams, lotions, balms, ointments, antiseptics, dentifrices and styptics.

They provide valuable suspending media for dye and pigment concentrates and printing inks, pesticide concentrates and drilling muds. In the presence of dense dissolved electrolytes such as calcium bromide they are particularly useful for oilfield packing fluids (used to fill the gap between the pipe and the inside of the borehole, to protect the former from mechanical stresses) and completion fluids in oil wells, or as cutting fluids or lubricants.

Novel Phases

G-phase compositions according to the invention are highly mobile, but are useful as solid suspending systems. They are preferably formed using said stabilizer but may alternatively be obtained by using other deflocculants such as the polymers described in EP. 0346995, GB2287813 and WO9106622.

Similarly the stabilised and novel $L_1$ systems of our invention are capable of being prepared with other deflocculants than said stabiliser. They are not useful as suspending media but supply a requirement for clear liquid detergents and shampoos at high surfactant and electrolyte levels.

We have discovered in particular that when compositions containing relatively high proportions of non-ionic surfactant are formulated with very high concentrations of water soluble electrolyte, such as potassium pyrophosphate a previously unreported structured phase is obtained containing an isotropic dispersed phase, comprising particles typically having a diameter of from 1 to 50 microns, which we believe to consist of a micellar phase, probably an $L_2$ inverse micellar phase or in some instances possibly anhydrous liquid surfactant, and a continuous phase which is typically either an isotropic phase probably $L_1$ or aqueous electrolyte, or a mobile mesophase such as a dilute anisotropic phase which we believe may be lamellar G-phase.

We have noted that progressive addition of a sufficiently soluble electrolyte to a composition containing relatively high proportions of non-ionic surfactant, initially causes the formation of a typical spherulitic composition, while the electrical conductivity of the composition passes through a peak and then falls to a minimum, after which it rises sharply to a second maximum. Near the minimum a marked change occurs with the dispersed phase changing from small, close packed, anisotropic spherulities to larger more widely spaced isotropic droplets in a predominantly isotropic or weakly anisotropic continuous phase. Optimum solid suspending systems are found within the first conductivity trough close to the conductivity minimum.

Typically our novel structured system contains from 15% to 100% based on the total weight of surfactant, more usually at least 30?, e.g. 40 to 90% especially 50 to 80% non-ionic surfactant such as alcohol ethoxylate or alkyl phenol ethoxylate together with anionic surfactants such as alkyl benzene sulphonate, alkyl sulphate or alkyl ethoxy sulphate. The composition contains high levels e.g. at least 15% especially more than 18% more preferably over 20% by weight of soluble electrolyte such as potassium pyrophosphate and/or potassium citrate.

The novel structured compositions generally tend to flocculate and require the presence of said stabiliser in order to be pourable.

The invention will be further illustrated by means of the following examples.

The thiol polyacrylate surfactant used as said stabillser in the following Examples was prepared by reacting hexadecanethiol and acrylic acid in a weight ratio of 24:76, in the presence of 0.005 parts by weight of azobis diisobutyronitrile and dissolved in acetone at a weight concentration of 55% of the total reagents based on the total weight of solution. The mixture was refluxed for one hour, the acetone distilled off and the residue dissolved in 17% by weight aqueous sodium hydroxide solution to form a 35% by weight solution of the surfactant. The product is more than 5% soluble in 18% potassium citrate solution. It is also soluble in 25% potassium citrate and at least 1% soluble in 35% potassium chloride solution.

EXAMPLE 1

A liquid laundry detergent composition comprises:

| | % by weight |
|---|---|
| Sodium alkyl benzene sulphonate | 8 |
| triethanolamine alkyl sulphate | 2 |
| fatty alcohol 3 mole ethoxylate | 11 |
| sodium tripolyphosphate | 20 |
| potassium pyrophosphate | 20 |
| silicone antifoam | 0.33 |
| sodium phosphonate sequestrant | 1 |
| optical brightener | 0.05 |
| perfume | 0.8 |
| water | balance |

The composition was made up with various concentrations of thiol polyacrylate stabiliser and the viscosity measured on a "Brookfield RVT" Viscometer Spindle 4 at 100 rpm, and at 20° C. The results are set out in the Table 1.

TABLE 1

| Wt % Stabiliser | Viscosity Pa % |
|---|---|
| 0 | >4.0 |
| 0.1 | 1.31 |
| 0.26 | 1.17 |
| 0.52 | 1.39 |
| 0.78 | 1.6 |
| 1.25 | 2.8 |

The product comprised isotropic droplets which appeared to be an $L_2$ phase in a continuous phase which appeared isotropic.

EXAMPLE 2

A number of aqueous surfactant compositions were prepared as shown in the following Table 2. Sodium citrate was added progressively to each up to 16.3% by weight (measured as monohydrate). Each composition passed through a homogeneous and stable, but viscous, region at certain citrate concentration, but underwent flocculation and separation as the maximum concentration of citrate was approached. In each case the addition of 2% by weight of a 27% by weight aqueous solution of the aforesaid thiol polyacrylate stabiliser with stirring, produced a homogeneous, deflocculated, mobile liquid, which on microscopic examination proved to be spherulitic.

TABLE 2

| | Sodium $C_{12-14}$ alkylbenzene sulphonate | $C_{12-14}$ alcohol 3 mole ethoxylate | Sodium $C_{12-14}$ alkyl 3 mole ethoxy sulphate |
|---|---|---|---|
| A | 35.7 | 10.2 | 0 |
| B | 35.7 | 5.1 | 5.1 |
| C | 30.6 | 15.3 | 0 |
| D | 30.6 | 10.2 | 5.1 |
| E | 25.5 | 20.4 | 0 |
| F | 25.5 | 15.3 | 5.1 |
| G | 20.4 | 25.5 | 0 |
| H | 20.4 | 20.4 | 5.1 |
| I | 15.3 | 30.6 | 0 |
| J | 15.3 | 25.5 | 5.1 |
| K | 13.2 | 32.6 | 0 |
| L | 13.2 | 30.6 | 2.0 |
| M | 13.2 | 26.5 | 6.12 |
| N | 5.1 | 30.6 | 10.2 |
| O | 5.1 | 25.5 | 15.3 |
| P | 5.1 | 20.4 | 20.4 |
| Q | 5.1 | 15.3 | 25.5 |
| R | 5.1 | 10.2 | 30.6 |

EXAMPLE 3

The compositions listed in Table 3 were all stable, mobile, spherulitic liquids. In the absence of said stabiliser they were viscous, flocculated pastes, which on standing separated into a curdy mass and about 10% by volume of a clear bottom layer.

N.B. All components expressed as 100% solids.

TABLE 3

| Component | A | B | C | D | E | F | G |
|---|---|---|---|---|---|---|---|
| Water | to 100 | to 100 | to 100 | to 100 | to 100 | to 100 | to 100 |
| Potassium hydroxide | 1.64 | 1.9 | — | — | 3.45 | 3.45 | 1.0 |
| Sodium hydroxide | — | — | 1.7 | 1.7 | — | — | — |
| Monoethanolamine | 2.87 | 3.06 | 2.6 | 2.6 | 2.8 | 2.8 | — |
| Optical Brightening Agent | 0.15 | 0.15 | 0.15 | 0.15 | 0.15 | 0.15 | 0.15 |
| Calcium chloride | 0.2 | 0.2 | 0.2 | 0.2 | 0.2 | 0.2 | 0.2 |
| Sodium ethylenediamine tetracetate | — | — | 0.55 | 0.55 | — | — | — |
| $C_{12}$–$C_{14}$ alkylbenzene sulphonic acid | 19.0 | 22.0 | 27.6 | 27.6 | 20.0 | 20.0 | — |
| $C_{12}$–$C_{14}$ alkyl 3 mole ethoxylate | 7.0 | 7.0 | — | 2.0 | 5.0 | 5.0 | 8.5 |
| $C_{12}$–$C_{14}$ alkyl 8 mole ethoxylate | — | — | 9.0 | — | 5.0 | 5.0 | — |
| Sodium $C_{12}$–$C_{14}$ alkyl ethoxy sulphate | — | — | — | — | — | — | 9.0 |
| Sodium citrate dihydrate | — | — | 14.5 | 14.5 | — | — | — |
| Potassium citrate monohydrate | 12.5 | 12.5 | — | — | 12.5 | — | 12.0 |
| Zeolite | 18.0 | 18.0 | — | — | — | — | 24.0 |
| Sodium pyroborate | 2.0 | 2.0 | — | — | — | — | — |
| Sodium metaborate | — | — | 4.0 | 4.0 | 3.0 | 3.0 | — |
| Potassium carbonate | — | — | — | — | — | — | 1.0 |
| Sodium diethylenetriamine pentakis (methylene phosphonate) | 3.0 | 3.0 | — | — | 4.0 | 4.0 | — |
| Enzyme | 0.4 | 0.4 | 1.4 | 1.4 | 0.4 | 0.4 | 0.4 |
| Alkylpolyglycoside (dp = 1.35) | 0.7 | 0.7 | — | 4.3 | — | — | — |
| Thiol polyacrylate | — | — | 0.25 | — | 0.25 | 0.25 | 0.25 |
| Potassium tripolyphosphate | — | — | — | — | — | 12.5 | — |
| Fatty acids $C_{12}$–$C_{18}$ (STPK) | — | — | — | — | 10.0 | — | 4.5 |
| Viscosity Brookfield Sp4, 100 rpm. (Pa s) | 1.05 | 1.575 | 0.6 | 0.85 | 0.42 | 0.36 | 1.26 |

EXAMPLE 4

An alkaline laundry cleaner for institutional use; e.g. in hospitals, and adapted for automatic dispensing, was prepared according to the following formula:

| | Wt % |
|---|---|
| Sodium hydroxide | 6.8 |
| Nonylphenyl-9 mole ethoxylate | 13.4 |
| Sodium $C_{12-14}$ linear alkyl benzene sulphonate | 14.0 |
| Sodium diethylene triamine pentakis (methylene phosphonate) | 7.0 |
| Antiredeposition Agent | 7.0 |
| Optical brightener | 0.05 |
| Thiol polyacrylate | 0.4 |

In the absence of the thiol polyacrylate stabiliser, the product was highly viscous and tended to separate into a thin liquid phase external to a curdy lump. Addition of the stabiliser provided a mobile, stable, spherulitic composition. Progressive addition of excess thiol polyacrylate caused a rise in viscosity to a maximum. However addition of a total of 3% of the thiol polyacrylate surfactant gave a thin, mobile translucent G phase with good solid suspending properties. Further addition of stabiliser gave a clear, optically isotropic, Newtonian, micellar solution.

EXAMPLE 5

A highly concentrated liquid laundry detergent was prepared by mixing together the following components in the order given.

| Component/Additional Order | % w/w Component | Form of Component |
|---|---|---|
| Water | Balance | |
| Sodium hydroxide | 5.92 | (47% soln) |
| Citric acid | 9.47 | Powder |
| Thiol polyacrylate | 0.4 | |

-continued

| Component/Additional Order | % w/w Component | Form of Component |
|---|---|---|
| $C_{12-14}$ alcohol nine mole ethoxylate | 9.0 | |
| Monoethanolamine | 5.2 | |
| Linear $C_{12-14}$ alkyl benzene sulphonic acid | 27.6 | (95.5%) |
| Dye | 0.025 | (1% soln) |
| Optical brightener | 0.15 | |
| Calcium chloride | 0.2 | |
| Sodium ethylene diamine tetracetate dihydrate | 0.55 | |
| Sodium metaborate | 4.0 | |
| Thiol polyacrylate | 0.6 | |
| Protease liquid | 0.05 | |
| Amylase liquid | 1.4 | |

The product was an opaque, stable, mobile spherulitic detergent composition having a viscosity of 0.65 Pas. At 21 $sec^{-1}$.

EXAMPLE 6

The following liquid laundry formulations were prepared.

| | % Active Ingredient | |
|---|---|---|
| Component | A | B |
| Optical brighteners | 0.5 | 0.5 |
| Sodium linear $C_{12-14}$ alkyl benzene sulphonate | 12 | 12 |
| Thiol polyacrylate | .75 | .5 |
| Potassium carbonate | 6.0 | 6.0 |
| Potassium tripolyphosphate | 14.0 | — |
| Tetrapotassium pyrophosphate | — | 7.5 |
| Sodium $C_{12-14}$ alkyl three mole ethoxy sulphate | 3.0 | 3.0 |
| Ethoxylated fatty alcohols[1] | 8.0 | 4.5 |
| Sodium tripolyphosphate | 20 | 23.5 |

-continued

| Component | % Active Ingredient A | B |
|---|---|---|
| Perfume | .5 | .5 |
| Dye | .0075 | .0075 |
| Water | BAL. | BAL. |

[1]Comprising equal weights of $C_{12-14}$ 3 mole ethoxylate and $C_{12-14}$ 8 mole ethoxylate.

EXAMPLE 7

A concentrated dye suspension was prepared having the formula by weight:

| | |
|---|---|
| Yellow dye ("Terasil Gelb") | 35% |
| Sodium linear $C_{12-14}$ alkyl benzene sulphonate | 6.5% |
| Sodium alkyl ethoxy sulphate | 3.25% |
| Potassium chloride | 2% |
| Sodium dimethylnaphthalenesulphonate formaldehyde condensate | 6% |
| 26% aqueous thiol acrylate stabiliser solution | 5% |
| Water | 42.25% |

The composition was mobile, stable and water dispensible. In the absence of stabiliser the composition was viscous and highly flocculated.

EXAMPLE 8

A concentrated dye suspension was prepared having the formula, by weight:

| | |
|---|---|
| Yellow dye ("Terasil" Gelb) | 35% |
| 95% active isopropylamine linear $C_{12-14}$ alkyl benzene sulphate | 5% |
| 30% aqueous thiol polyacrylate stabiliser solution | 5% |
| 40% aqueous sodium di methylnapthalenesulphonate/ formaldehyde condensate | 6% |
| Water | 49% |

The composition was mobile, stable, and readily dispersible in water. In the absence of the stabiliser the composition appears flocculated with separation of the surfactant accompanied by sedimentation of the dispersed dye.

EXAMPLE 9

A metal degreaser was prepared having the formula by weight:

| | |
|---|---|
| Nonyl phenyl 9-mole ethoxylate | 8.2% |
| $C_{12-14}$ alkyl 3 mole ethoxylate | 10.3% |
| 30% aqueous thiol acrylate solution | 1.5% |
| 40% aqueous sodium ethylhexyl sulphate solution | 6.8% |
| Sodium tripolyphosphate | 24.0% |
| 15% aqueous sodium orthophosphate solution | 47.9% |
| 25% aqueous sodium hydroxide solution | 1.3% |

The composition was mobile and stable. In the absence of the stabiliser it was viscous and separated on standing.

EXAMPLE 10

Two drilling muds were formulated comprising in wt. %:

| | A | B |
|---|---|---|
| Calcium $C_{12-14}$ alkyl 3 mole ethoxy sulphate | 6.8 | 6.7 |
| Calcium oxide | 0.8 | 0.8 |
| Water | 54.5 | 53.6 |
| Silicone antifoam | 0.2 | 0.4 |
| Calcium chloride dihydrate | 34.1 | 34.0 |
| $C_{12-14}$ alkylbenzene sulphonic acid | 3.6 | 3.9 |
| $C_{12-16}$ alkyl 20 mole ethoxylate (stabiliser) | 0 | 1.2 |

Sample A was highly flocculated, giving a viscoelastic fluid which gelled instantly on being sheared by stirring at 300 rpm. Prior to shearing A had an initial yield point of 0.1 N and a viscosity at 21 $sec^{-1}$ of 0.5 Pas. The viscosity fell under increased shear to a substantially constant viscosity of 0.17 Pas.

In contrast the sample B containing the stabiliser was a stable, fluid having an initial yield point of 0.1 N and a viscosity at 21 $sec^{-1}$ of 0.55 Pas rising with increasing shear to a constant value of 0.09 Pas.

After mixing at 300 rpm for 15 minutes the product had in initial yield of 0.17 N, and viscosity at 21 $sec^{-1}$ of 0.38 Pas falling to a constant value of 0.087 Pas at higher shear rates. The composition was suitable for use as a drilling mud, spacer fluid, completion fluid or packing fluid.

EXAMPLE 11

A drilling mud formulation was prepared as follows:

| | Wt % |
|---|---|
| Calcium $C_{12-14}$ alkyl 3 mole ethoxy sulphate | 6.7 |
| Calcium oxide | 0.8 |
| $H_2O$ | 51.8 |
| Silicon antifoam | 0.4 |
| Calcium chloride dihydrate | 34.0 |
| $C_{12-14}$ alkylbenzene sulphonic acid | 3.9 |
| Poly AMPS stabiliser* | 3.0 |

*The stabiliser was a polymer of 2-acrylamido-2-methylpropane sulphonic acid having a mean degree of polymerisation of 12.

The product was stable and had an initial yield of 0.17N, a viscosity of 21 $sec^{-1}$ of 1.7 Pas and a steady viscosity of 0.13 Pas. After 15 minutes at 300 rpm the initial yield point was 0.3N and the viscosity at 21 $sec^{-1}$ was 1.0 Pas falling to a steady value of 0.9 Pas at increasing shear.

EXAMPLE 12

The following concentrated surfactant system was prepared in potassium chloride electrolyte and deflocculated by addition of an alcohol twenty mole ethoxylate.

| | |
|---|---|
| Sodium linear $C_{12-14}$ alkyl benzene sulphate | 12% |
| Sodium alkyl ethoxy sulphate | 6% |
| Potassium chloride | 18% |
| $C_{16-18}$ alcohol (20EO) ethoxylate | 0.5% |
| Water | 63.5% |

The composition was mobile and stable, giving a viscosity (shear rate 21 $sec^{-1}$) of 0.35 Pa s. In the absence of alcohol ethoxylate stabiliser, it was viscous and separated on standing.

EXAMPLE 13

The deflocculating effect of the stabiliser and the viscosity of the deflocculated system is controlled by the concentration of added destabiliser. A minimum quantity of stabiliser is required to deflocculate, the quantity being dependent upon the deflocculant structure and the composition of the flocculated system. Once deflocculation has been obtained, on increasing the destabiliser concentration, the viscosity of the system passes through a minimum then increases to a maximum.

EXAMPLE 14

It is believed that for each flocculated surfactant series, there is a sharp distinction based on headgroup size between those species which have a headgroup sufficiently large to deflocculate, and those which have minimal deflocculating effect:

| Component | A | B | C | D | E | F | G |
|---|---|---|---|---|---|---|---|
| Water | 45% | 44.99 | 45.95 | 45.75 | 45.75 | 45.5 | 44 |
| Monnoethanolamine $C_{12-14}$ alkyl benzene sulphonic acid | 30% | 30% | 30% | 30% | 30% | 30% | 30% |
| $C_{12-14}$ alkyl 8 mole ethoxylate | 10% | 10% | 10% | 10% | 10% | 10% | 10% |
| Potassium citrate monohydrate | 15% | 15% | 15% | 15% | 15% | 15% | 15% |
| Alkyl thiol polyacrylate | 0% | 0.01 | 0.05 | 0.1 | 0.25 | 0.5 | 1% |
| Viscosity Pa sec (21 $sec^{-1}$) | flocculated | flocculated | 0.11 | 0.08 | 0.89 | 1.28 | gel |

| Component | H | I | J | K | L | M | N |
|---|---|---|---|---|---|---|---|
| Water | 45 | 44.95 | 44.9 | 44.75 | 44.5 | 44 | 43 |
| Potassium citrate monohydrate | 25% | 25% | 25% | 25% | 25% | 25% | 25% |
| $C_{12-14}$ amine oxide | 7.5% | 7.5% | 7.5% | 7.5% | 7.5% | 7.5% | 7.5% |
| Sodium oleate | 7.5% | 7.5% | 7.5% | 7.5% | 7.5% | 7.5% | 7.5% |
| Sodium alkyl ethoxy sulphate | 7.5% | 7.5% | 7.5% | 7.5% | 7.5% | 7.5% | 7.5% |
| Alkyl thiol polyacrylate | 0% | 0.05 | 0.10 | 0.25 | 0.5 | 1 | 2 |
| Viscosity Pasec (21 $sec^{-1}$) | flocculated | 0.05 | 0.10 | 0.59 | 1.0 | gel | gel |

This is illustrated by the following surfactant system which may be deflocculated by alkyl poly glucoside. X is the minimum percentage by weight of alkyl polyglycoside required for deflocculation.

| | |
|---|---|
| Monoethanolamine $C_{12-14}$ alkyl benzene sulphonate | 30% |
| $C_{12-14}$ alkyl 8 mole ethoxylate | 10% |
| Potassium citrate monohydrate | 15% |
| Alkyl polyglycoside | x% |
| Water | Balance |

The degree of polymerisation (DP) of an alkyl poly glucoside, may be defined as the mean number of repeat glucoside units per alkyl poly glucoside molecule, and can be determined by techniques of GLC or GPC.

Hence, the effect of deflocculant headgroup size on deflocculation can be illustrated by observing the effect of alkyl poly glucoside DP on deflocculation. In the above system, x is the minimum quantity of APG required to cause deflocculation.

| | DP (determined by GLC) | x |
|---|---|---|
| APG 1 | 1.27 | 4% |
| APG 2 | 1.32 | 4% |
| APG 3 | 1.50 | 3.0–4.0% |
| APG 4 | 1.67 | 2.5–2.7% |
| APG 5 | 1.71 | 1% |
| APG 6 | 2.02 | 0.75% |

EXAMPLE 15

Example 14 was repeated using a range of higher DP alkylpolyglycosides, in order to determine which components of the alkyl polyglycoside products were most responsible for deflocculation.

The following table indicates the estimated distribution of glycoside oligomers for each of the alkyl polyglucoside products tested. In this surfactant system, effective deflocculation was observed for oligomers with a degree of polymerisation greater than or equal to seven. Lower degrees of polymerisation give weak deflocculation only.

| x | % mono | % di | % tri | % tetra | % penta | % hexa | %>/hepta |
|---|---|---|---|---|---|---|---|
| 0.1% | 0.0 | 0.0 | 0.0 | 0.0 | 0.0 | 0.0 | 100.0 |
| 0.2% | 0.2 | 1.1 | 2.6 | 5.9 | 8.5 | 10.7 | 71.0 |
| 1% | 1.1 | 6.6 | 15.1 | 20.2 | 20.2 | 16.8 | 20.0 |
| 2% | 16.0 | 16.0 | 14.5 | 12.7 | 11.6 | 9.6 | 19.5 |
| *>>2% | 35.8 | 26.8 | 16.3 | 8.9 | 5.3 | 3.2 | 3.7 |
| *5% | 0.0 | 100.0 | 0.0 | 0.0 | 0.0 | 0.0 | 0.0 |

*weakly deflocculated only

EXAMPLE 16

The reason for the connection between headgroup size and deflocculating effect appears to be in part derived from the relationship between headgroup size and the interlamellar spacing of the spherulites.

Smaller spacing has been observed to require a smaller headgroup size for deflocculation. This is illustrated by the following example:

| | System 1 | System 2 |
|---|---|---|
| Monoethanolamine $C_{12-14}$ alkyl benzene sulphonate | 30% | 30% |
| $C_{12-14}$ alkyl 8 mole ethoxylate | 10% | 10% |
| Potassium citrate monohydrate | 15% | 40% |
| Alkyl polyglucoside DP1.27 | x% | x% |
| Water | Balance | Balance |

Interlamellar spacing (by X-ray diffractometry) was substantially reduced by increasing the electrolyte content.

| x% | Viscosity (21 $sec^{-1}$) System 1 | Viscosity (21 $sec^{-1}$) System 2 |
|---|---|---|
| 1 | Flocculated | Flocculated |
| 2 | Flocculated | Deflocculated - 0.4 Pasec |
| 3 | Flocculated | Deflocculated - 0.2 Pasec |
| 4 | Deflocculated - 0.8 Pasec | Deflocculated - 0.29 Pasec |
| 5 | Deflocculated - 1.0 Pasec | Deflocculated - 0.9 Pasec |

EXAMPLE 17

The following ingredients were mixed in the order shown.

| Component | % w/w solids |
|---|---|
| Water | balance to 100% |
| $C_{12-14}$ alkyl 1.32 dp glycoside (added as 70% solution) | 1.00 |
| Optical Brightener (TINOPAL CBS/X) | 0.15 |
| Calcium acetate | 0.20 |
| Potassium hydroxide (added as 50% solution) | 1.64 |
| Monoethanolamine | 2.87 |
| Stripped palm kernel fatty acid | 4.00 |
| Tripotassium citrate monohydrate | 11.50 |
| Sodium $C_{12-14}$ alkyl benzenesulphonate | 19.00 |
| Antifoam | 0.05 |
| Zeolite | 18.00 |
| Perfume | 1.30 |
| $C_{12-14}$ alcohol 3 mole ethoxylate | 7.00 |
| Borax | 2.00 |
| Antifoam | 0.05 |
| Enzyme (SAVINASE 16.OLEX) | 0.40 |
| Bacteriostat (PROXEL GXL) | 0.05 |
| Dye | 0.002 |
| $C_{12-14}$ alkyl 1.32 dp glycoside (as 70% solution) | 1.00 |

"TINOPAL" "SAVINASE" and "PROXEL" are registered trade marks.

The composition was a mobile, stable, opaque, spherulitic liquid having the following characteristics:

| | |
|---|---|
| pH (concentrated) | 9.5 |
| pH (1% solution) | 9.0 |
| Viscosity (Brookfield RVT sp4 100 rpm) | 1.0 Pa s |
| Density | 1.25 g $cm^{-1}$ |

In the absence of the alkyl polyglycoside the product was highly flocculated. A slight thickening observed towards the end of the mixing was corrected by the final addition of alkyl polyglycoside.

EXAMPLE 18

The following ingredients were mixed in the order shown.

| Component | % w/w solids |
|---|---|
| Water | balance to 100% |
| Optical brightening agent (TINOPAL CBS/X) | 0.1 |
| Disodium ethylenediamine tetracetate | 0.55 |
| Calcium chloride dihydrate | 0.20 |
| Dye | 0.025 |
| Sodium hydroxide | 5.92 |
| Monoethanolamine | 5.20 |
| Citric acid | 9.47 |
| Thiol polyacrylate stabiliser | 0.0625 |
| Linear alkylbenzene sulphonic acid | 12.00 |
| Sodium Metaborate | 4.00 |
| Thiol polyacrylate stabiliser | 0.1875 |
| Enzyme | 1.40 |

The product was a stable, mobile, spherulitic liquid. In the absence of the stabiliser the product was heavily flocculated.

EXAMPLES 19–21

Following ingredients were mixed in the order given.

| | % w/w | | |
|---|---|---|---|
| Component | Example 19 | Example 20 | Example 21 |
| Water | Balance | Balance | Balance |
| Optical brightener (TINOPAL CBS/X) | 0.1 | 0.1 | 0.1 |
| Sodium ethylensdiamine tetracetate | 0.55 | 0.55 | 0.55 |
| Sodium hydroxide | 8.75 | 6.14 | 6.14 |
| Linear alkylbenzene sulphonic acid | 25.48 | 18.65 | 18.65 |
| Nonylphenyl 9 mole ethoxylate | 12.00 | — | 6.0 |
| $C_{12-14}$ alkyl 12 mole ethoxylate | — | 8.0 | 6.0 |
| $C_{12-14}$ alkyl 9 mole ethoxylate | — | 4.0 | — |
| Sodium metaborate | 2.0 | 2.0 | 2.0 |
| Calcium chloride | 0.2 | 0.2 | 0.2 |
| Bacteriostat (PROXEL GXL) | 0.05 | 0.05 | 0.05 |
| Citric acid | 9.15 | 6.53 | 6.53 |
| Dye | 0.025 | 0.025 | 0.025 |
| Thiol polyacrylite stabiliser | 1.0 | 1.0 | 1.0 |

The product is a pourable, opaque, solid-free, stable liquid. In the absence of the stabiliser the product is immobile.

EXAMPLES 22 AND 23

The following ingredients were mixed in the order shown:

| | % w/w solids | |
|---|---|---|
| Components | Example 22 | Example 23 |
| Potassium hydroxide | 3.38 | 3.38 |
| $C_{12-14}$ alcohol 8 mole ethoxylate | 5.0 | 5.0 |
| $C_{12-14}$ alcohol 3 mole ethoxylate | 5.0 | 5.0 |
| Coco fatty acid | 10.0 | 10.0 |
| Linear $C_{12-14}$ alkyl, benzene sulphonate | 20.7 | 20.7 |
| Potassium tripolyphosphate | — | 12.5 |
| Tripotassium citrate monohydrate | 12.5 | — |
| Sodium diethylenetriamine pentakis (methylenephosphonate) | 4.0 | 4.0 |

-continued

| Components | % w/w solids Example 22 | Example 23 |
|---|---|---|
| Bacteriostat (PROXEL CGL) | 0.05 | 0.05 |
| Enzyme (SAVINASE 16. OLEX) | 0.4 | 0.4 |
| Optical Brightener (TINOPAL CBS/X) | 0.15 | 0.15 |
| Calcium chloride dihydrate | 0.2 | 0.2 |
| Sodium metaborate | 3 | 3 |
| Thiol polyacrylate stabiliser | 1 | 1 |
| Water | Balance | Balance |
| Viscosity (Brookfield RVT, sp4 100 rpm) | 0.38 Pa s | 0.6 Pa s |
| Specific gravity | 1.13 $gcm^{-3}$ | 1.13 $gcm^{-3}$ |
| pH conc. | 10.9 | 10.7 |

The product in each case was a mobile liquid. When the same formulation was prepared without stabiliser a highly viscous, curdled product was obtained.

EXAMPLE 24

The following composition was stable and pourable in the absence of aminophosphinate. The aminophosphinate was prepared according to the method described in Example 1 of EP-A-O 419 264. The washing performance of the product was substantially inferior to that of a tripolyphosphate built detergent. Addition of the aminaphosphinate substantially improved the washing performance, but concentrations greater than 2% by weight caused heavy flocculation with separation into a thin liquid and a viscous curd.

Addition of said stabiliser enabled the aminophosphinate level to be raised to 5.75 by weight without adversely effecting the stability or viscosity of the product.

| Component | Wt % based on weight of composition |
|---|---|
| Optical brighter | 0.13 |
| Calcium acetate | 0.09 |
| $C_{12-14}$ alcohol 3 mole ethoxylate | 2.65 |
| Silicone defoamer | 0.18 |
| Triethanolamine | 2.08 |
| Tripotassium citrate monolydrate | 12.17 |
| Zeolite powder | 21.24 |
| Sodium diethylenetriamine pentakis (methylenephosphonate) | 0.66 |
| Sodium $C_{10-18}$ fatty acid | 4.25 |
| Sodium linear $C_{12-14}$ alkyl benzene sulphonate | 2.78 |
| Sodium $C_{12-14}$ alkyl 3 mole ethoxysulphate | 4.35 |
| Potassium carbonate | 1.77 |
| Enzymes | 0.8 |
| Perfume | 0.35 |

-continued

| Component | Wt % based on weight of composition |
|---|---|
| Aminophosphinate | 5.75 |
| Thiol polyacrylate stabiliser | 0.25 |
| Water | Balance |

EXAMPLES 25 AND 26

The following fabric conditioner formulations were prepared. In the absence of the alkyl ethoxylate stabiliser, they were viscous and unstable separating rapidly on standing. The inclusion of the ethoxylate proved effective in providing a stable, pourable composition.

Anionic surfactants such as thiol polyacrylates were not effective.

| Components | % w/w solids Example 25 | Example 26 |
|---|---|---|
| 1-methyl-1-tallowyl amidoethyl-2 tallowyl imidazolinium methosulphate (75% active aqueous isopropanol) | 31.7 | 31.7 |
| Sodium tripolyphosphate | 2.5 | — |
| Trisodium citrate dihydrate | — | 2.5 |
| $C_{12-14}$ alcohol eight mole ethoxylate | 0.1 | |
| $C_{16-18}$ alcohol fifty mole ethoxylate | | 0.1 |
| Water | Balance | Balance |

We claim:

1. An aqueous surfactant composition consisting essentially of:

15 to 30% by weight of builder;

at least one surfactant which is capable of forming a flocculated system;

an aqueous phase which forms with said surfactant a flocculated system;

a stabilizer, which is a compound, compatible with said surfactant and capable of forming micelles in said aqueous phase, said stabilizer having a hydrophobic group with from 5 to 25 carbon atoms linked at one end to one end of at least one hydrophilic group with a mass of at least 300 amu, in an amount sufficient to inhibit the flocculation of the system; and wherein said stabilizer has a hydrophilic polymer group with from six to eighty monomer units and linked at one end to a $C_8$ to $C_{25}$ alkyl group;

said stabilizer being an alkyl thiol capped polyacrylate;

and wherein said surfactant and said stabilizer are present in a total amount of from 2 to 80% by weight of the composition.

* * * * *